US006973285B2

(12) United States Patent
Sekiyama et al.

(10) Patent No.: US 6,973,285 B2
(45) Date of Patent: Dec. 6, 2005

(54) DISCHARGE SHEET STACKING APPARATUS AND IMAGE FORMING APPARATUS PROVIDED WITH THE SAME

(75) Inventors: Junichi Sekiyama, Shizuoka (JP); Yasuyoshi Hayakawa, Shizuoka (JP); Takashi Kuwata, Shizuoka (JP); Atsushi Ogata, Shizuoka (JP); Kenichiro Isobe, Shizuoka (JP); Masayoshi Fukatsu, Shizuoka (JP); Hironobu Ata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 10/390,920

(22) Filed: Mar. 19, 2003

(65) Prior Publication Data

US 2003/0185612 A1 Oct. 2, 2003

(30) Foreign Application Priority Data

Mar. 26, 2002 (JP) ..... 2002-086467
Jul. 26, 2002 (JP) ..... 2002-217721

(51) Int. Cl.[7] ..... G03G 15/00; B65H 5/22; B65H 83/00

(52) U.S. Cl. ..... 399/367; 399/361; 399/365; 399/369; 271/3.14; 271/3.19; 271/4.01

(58) Field of Search ..... 399/367, 365, 399/361, 369; 271/3.14, 3.19, 4.01, 3.15, 271/278, 217, 215; 270/58.8, 58.11

(56) References Cited

U.S. PATENT DOCUMENTS 4,449,812 A * 5/1984 Furuichi et al. ..... 399/403
4,819,023 A * 4/1989 Kitahara ..... 399/367
5,155,537 A 10/1992 Komatsu et al. ..... 355/309
5,292,116 A 3/1994 Inoue et al. ..... 271/157
5,348,284 A 9/1994 Ishihama et al. ..... 271/160
5,465,141 A 11/1995 Asano et al. ..... 355/285
5,765,826 A 6/1998 Isoda et al. ..... 271/162
6,206,369 B1 3/2001 Hoshii et al. ..... 271/290
6,302,606 B1 10/2001 Hayakawa et al. ..... 400/625
6,318,718 B1 11/2001 Ogata et al. ..... 271/213
6,325,371 B1 12/2001 Araki et al. ..... 271/297
6,341,772 B1 * 1/2002 Waragai et al. ..... 270/58.08
6,382,616 B1 5/2002 Waragai et al. ..... 270/58.12

(Continued)

FOREIGN PATENT DOCUMENTS

JP 11060044 A * 3/1999 ..... B65H 37/04

*Primary Examiner*—Daniel J. Colilla
*Assistant Examiner*—Marvin P. Crenshaw
(74) *Attorney, Agent, or Firm*—Fitzpatrick, Cella, Harper & Scinto

(57) ABSTRACT

A sheet post-treating apparatus is provided with a discharged sheet stacking tray displaceably provided in a casing portion for stacking thereon sheets discharged from the casing portion, and a holding portion for holding the discharged sheet stacking tray in a first position and a second position overlying the first position, and is designed such that the sheets are stacked on the discharged sheet stacking tray when in the first position, and therefore, when the sheet post-treating apparatus is incorporated into a printer and a cartridge in the printer is to be interchanged with a cartridge cover opened, a user can retract the discharged sheet stacking tray to the second position to thereby interchange the cartridge.

22 Claims, 33 Drawing Sheets

U.S. PATENT DOCUMENTS 6,581,922 B2 * 6/2003 Kuwata et al. ..... 270/58.11
6,661,995 B2 * 12/2003 Isobe et al. ..... 399/410
6,671,491 B1 * 12/2003 Yamanaka et al. ..... 399/407
6,674,976 B2 * 1/2004 Sato et al. ..... 399/18
6,681,097 B2 * 1/2004 Kimura et al. ..... 399/405
6,733,007 B2 * 5/2004 Sekiyama et al. ..... 271/65
6,735,415 B2 * 5/2004 Isobe et al. ..... 399/410
2002/0081124 A1 6/2002 Kuwata et al. ..... 399/107
2003/0044209 A1 3/2003 Isobe et al. ..... 399/410

* cited by examiner

DISCHARGE SHEET STACKING APPARATUS AND IMAGE FORMING APPARATUS PROVIDED WITH THE SAME

BACKGROUND OF THE INVENTION

1. Field of the Invention

This invention relates to a discharged sheet stacking apparatus on which sheets are stacked, and an image forming apparatus provided with this discharged sheet stacking apparatus in an image forming apparatus main body. Particularly, the invention relates to an image forming apparatus provided with a discharged sheet stacking apparatus designed such that when an ambient member is moved, a discharged sheet stacking tray does not abut against the member in an image forming apparatus.

2. Related Background Art

Heretofore, many image forming apparatuses, such as copying machines, printers, facsimile apparatuses and those combination machines thereof, have been designed such that sheets on which images have been formed (printed) are stacked on a discharged sheet stacking apparatus provided downstream of the discharge port of the image forming apparatus.

Among such image forming apparatuses, there is one of a type in which a sheet discharged from the discharge port of the image forming apparatus is received by and stacked on a discharged sheet stacking apparatus. Also, recently, there have appeared in the market of image forming apparatuses, in order to reduce the footprint for space saving, a discharge sheet stacking apparatus that is positioned on the upper portion of the main body of the image forming apparatus and a sheet discharged from a sheet discharge port on the image forming apparatus side located on the upper surface of the discharged sheet stacking apparatus is received by and stacked on the discharged sheet stacking apparatus. Also, regarding the same problem of footprint, image forming apparatuses of a tall type, which are slim and tall as a whole and which have a great deal of sheet supplying options for supplying a great deal of sheets, is disposed on the lower layer of an image forming apparatus main body.

The footprint refers to a floor area occupied by a printer. That is, it refers to an installation area. As regards the footprint, it is a matter of course that if discharged sheets are placed not on a floor but on the upper portion of the main body of the printer, the installation area as a system decreases.

Now, many of these image forming apparatuses are of a type, in which when, for example, a toner cartridge is to be interchanged, a cartridge cover provided on the upper surface of the image forming apparatus is opened to thereby interchange the toner cartridge from above. Also, in order to improve operability, some of them are such that the cartridge cover has the operating portion of the image forming apparatus.

In the image forming apparatuses of these types, however, it is sometimes the case that when a cartridge cover has been opened, the cover strikes against the discharged sheet stacking apparatus disposed on the upper portion of the image forming apparatus and it is difficult to interchange a toner cartridge. Also, when the cover is opened by force, the cover may strike against the discharged sheet stacking tray of the discharged sheet stacking apparatus, whereby the discharged sheet stacking tray and the cover may be damaged. Also, an operating portion provided on the cartridge cover may strike against the discharged sheet stacking tray of the discharged sheet stacking apparatus to thereby push an operating button by mistake, whereby the printer may be wrongly operated. Also, in some cases, the discharged sheet stacking tray may collide against the operating portion to thereby damage a liquid crystal panel provided in the operating portion.

So, it is conceivable to detach the whole of the discharged sheet stacking apparatus or the discharged sheet stacking tray during the interchange of the cartridge, but this is cumbersome to a user. Or, if the space in which the cover is pivotally moved is sufficiently secured, the position at which the discharged sheet stacking tray is mounted with respect to the image forming apparatus main body must be made high and the discharged sheet stacking apparatus must be disposed on the image forming apparatus main body, and now that image forming apparatuses of a tall type are increased, the height of the entire image forming apparatus becomes great and it may become difficult for the user to use the discharged sheet stacking apparatus.

A similar problem has also arisen in an image forming apparatus provided with a door for maintenance provided on the upper surface of the image forming apparatus and adapted to be opened and closed when jam treatment or maintenance management is done.

SUMMARY OF THE INVENTION

The present invention has as its object to provide a discharged sheet stacking apparatus designed such that when a circumferential member located around it has been moved, a discharge sheet stacking tray does not abut against the member, and an image forming apparatus equipped with this discharged sheet stacking apparatus in the main body thereof, and enabling the interchange, maintenance, etc. of parts to be easily done without the height of the discharged sheet stacking apparatus being made great.

In order to achieve the above object, the discharged sheet stacking apparatus is provided with a sheet treating portion for subjecting conveyed sheets to treatment, a discharged sheet stacking tray displaceably provided in the lower portion of the sheet treating portion in the manner that its position is variable and on which the sheets discharged from the sheet treating portion are stacked, and holding means for holding the discharged sheet stacking tray in a first position and a second position overlying the first position, and the discharged sheet stacking tray is designed such that the sheets are stacked thereon in the first position.

The discharged sheet stacking apparatus of the present invention is further provided with position detecting means for detecting that the discharged sheet stacking tray is in the second position.

The position detecting means of the discharged sheet stacking apparatus of the present invention serves also as sheet jam detecting means for detecting the jam of the sheets stacked on the discharged sheet stacking tray.

The position detecting means of the discharged sheet stacking apparatus of the present invention serves also as a full load detecting portion for detecting that the discharged sheet stacking tray is fully loaded with the sheets.

The holding means of the discharged sheet stacking apparatus of the present invention is provided with a rotary member provided with an engaged portion for holding the discharged sheet stacking tray in the second position, and an engagement portion provided on the discharged sheet stacking tray, and is adapted to release the discharged sheet stacking tray from the second position by the rotary member being rotated.

In order to achieve the above object, the image forming apparatus is provided with an apparatus main body openably and closably having an openable and closable portion, image forming means provided in the apparatus main body for forming an image on a sheet, and a discharged sheet stacking apparatus on which the sheet on which the image has been formed by the image forming means is stacked, and the discharged sheet stacking tray is positioned above the openable and closable portion.

The discharged sheet stacking tray of the image forming apparatus of the present invention has a receiving portion for receiving the openable and closable portion at a location opposed to the openable and closable portion.

The receiving portion of the image forming apparatus of the present invention is detachably provided on the discharged sheet stacking tray.

The receiving portion of the image forming apparatus of the present invention has a low friction member lower in coefficient of friction than the receiving portion, in a portion against which the openable and closable portion abuts.

Also, in order to solve the above-noted problem, the typical construction of a sheet post-treating apparatus according to the present invention and an image forming apparatus provided with the same is characterized in that in a discharged sheet stacking apparatus having a discharged sheet stacking tray detachably connected to above an image forming apparatus main body for stacking thereon a sheet on which an image is formed by the image forming apparatus main body and which is discharged, the discharged sheet stacking tray being positioned above an openable and closable portion formed in the upper portion of the image forming apparatus main body, the discharged sheet stacking tray has contact preventing means disposed at a location whereat it abuts against the openable and closable portion with the openable and closable portion being opened for avoiding the contact of the discharged sheet stacking tray with an operating portion provided on the openable and closable portion.

Also, in order to solve the above-noted problem, the typical construction of an image forming apparatus main body according to the present invention and an image forming apparatus provided with the same is an image forming apparatus main body for forming an image on a sheet and in which a discharged sheet stacking apparatus having a discharged sheet stacking tray on which sheets discharged with images formed thereon are stacked is detachably connected to above the image forming apparatus main body, and which has an openable and closable portion below the discharged sheet stacking tray, characterized in that the openable and closable portion has contact preventing means provided at a location whereat it abuts against the discharged sheet stacking tray in the opened state of the openable and closable portion for avoiding the contact of the discharged sheet stacking tray with an operating portion provided on the openable and closable portion, and the contact preventing means is a convex portion of a predetermined height detachably provided on the openable and closable portion, and is disposed at a locating avoiding the operating portion.

According to the above-described construction, the discharged sheet stacking apparatus of the present invention is designed such that the discharged sheet stacking tray has its position changed from a first position to a second position overlying the first position and sheets are stacked thereon in the first position and therefore, in the case that an ambient member, e.g., the discharged sheet stacking apparatus, is incorporated into the image forming apparatus main body and the openable and closable portion for opening and closing the image forming apparatus main body is opened and closed for the interchange of a cartridge in the image forming apparatus, the treatment of a jam, maintenance or the like, the user can retract the discharged sheet stacking tray to the second position, and it becomes unnecessary to detach the discharged sheet stacking tray or to provide in advance the discharged sheet stacking apparatus upwardly relative to the image forming apparatus main body by an amount corresponding to a space required by the openable and closable portion for its pivotal movement.

Further, the discharged sheet stacking tray is displaceably constructed and therefore, the discharged sheet stacking tray can be retracted to the second position with a slight operating force.

Also, the discharged sheet stacking tray is provided with contact preventing means disposed at a location whereat it abuts against the openable and closable portion in the opened state of the openable and closable portion for avoiding the contact of the discharged sheet stacking tray with the operating portion provided on the openable and closable portion, whereby without a sufficient height for opening and closing a cartridge cover being secured, an operating button can be prevented from being pushed by the discharged sheet stacking tray to thereby wrongly operate the image forming apparatus. Consequently, without a sufficient space for opening and closing the openable and closable portion being secured, the wrong operation of the image forming apparatus can be prevented and thus, there can be provided a compact and inexpensive discharged sheet stacking apparatus.

Also, the contact preventing means is a convex portion of a predetermined height provided on the discharged sheet stacking tray, and is disposed at a location avoiding the operating portion. Thereby, the liquid crystal panel portion or the like of the operating portion can be prevented from being damaged. Also, it is unnecessary to provide the operating portion with a countermeasure for the prevention of the wrong operation and damaging or the like of the operating portion and therefore, the free design of the operating portion becomes possible and high designability can be obtained.

Also, the contact preventing means is a tray concave portion of a predetermined depth provided in the underside of the discharged sheet stacking tray, and is designed such that when the openable and closable portion is opened and closed, the operating portion and the operating button of the operating portion come into the tray concave portion, whereby it is unnecessary to provide a member protruding from the discharged sheet stacking tray and thus, the appearance of the discharged sheet stacking apparatus is not spoiled.

Also, in the image forming apparatus main body, the openable and closable portion has contact preventing means provided at a location whereat it abuts against the discharged sheet stacking tray in the opened state of the openable and closable portion for avoiding the contact of the discharged sheet stacking tray with an operating portion provided on the openable and closable portion, and the contact preventing means is a convex portion of a predetermined height detachably provided on the openable and closable portion, and is disposed at a location avoiding the operating portion. Thereby, when any sheet post-treating apparatus is connected to above, there can be obtained the effects of preventing the wrong operation of the image forming apparatus, and preventing the damaging of the liquid crystal panel or the like.

DESCRIPTION OF THE PREFERRED EMBODIMENTS

A sheet post-treating apparatus containing therein a discharged sheet stacking apparatus according to an embodiment of the present invention and a laser beam printer (hereinafter referred to as the "printer") which is an image forming apparatus will hereinafter be described with reference to the drawings.

The sheet post-treating apparatus 300 is provided on the upper portion of an image forming apparatus main body 100A as one of the constituents of the printer 101.

(First Embodiment)

The printer 101 provided with a sheet post-treating apparatus 300 according to a first embodiment of the present invention will hereinafter be described with reference to FIGS. 1 to 13.

Figure 1:
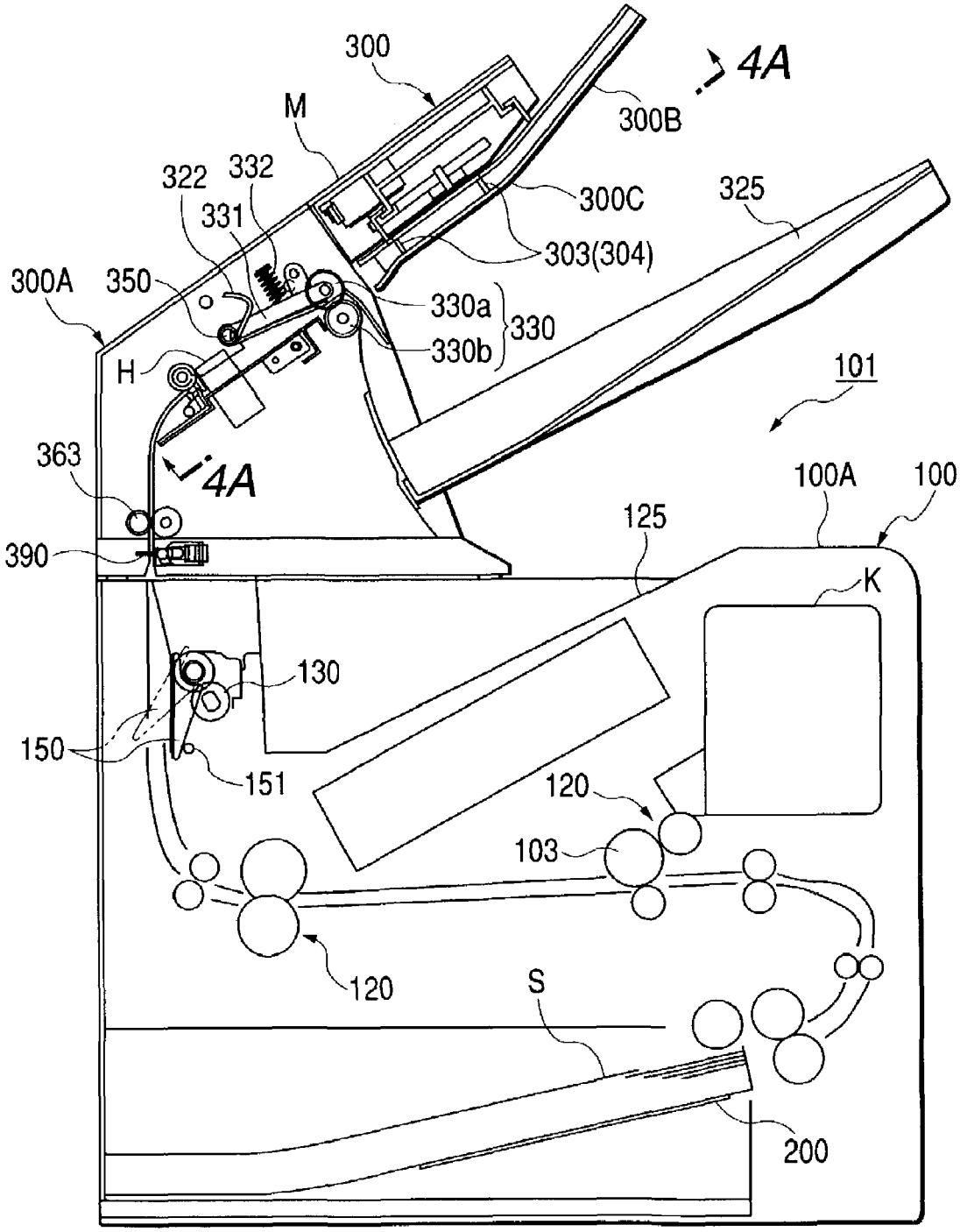
FIG. 1 is a cross-sectional view, with a position detecting portion omitted, of a printer which is an image forming apparatus having mounted on the main body thereof a sheet post-treating apparatus which is a discharged sheet stacking apparatus according to a first embodiment of the present invention.

FIG. 1 is a schematic cross-sectional view showing the general construction of the printer 101 provided with the sheet post-treating apparatus 300 according,to the first embodiment of the present invention.

In FIG. 1, the printer 101 is an apparatus having a main body 100 singly connected to a computer or to a network such as LAN and for forming (printing) an image on a sheet by a predetermined image forming process on the basis of image information, a print signal or the like sent from the computer or the network, and discharging the sheet. This printer 101 may be provided with a reading portion for reading an original, and may be designed to copy the image of the original on the sheet on the basis of the read information by the reading portion and discharge the sheet.

The sheet post-treating apparatus 300 is adapted to effect the widthwise alignment of sheets fed thereto from the printer main body 100 and make the sheets into a bundle shape, and thereafter discharge them onto a discharged sheet stacking tray 325, or bind the bundle of sheets by a stapler H and discharge the sheets onto the discharged sheet stacking tray 325.

That is, the sheet post-treating apparatus 300 is adapted to place the sheets fed thereto from the printer main body 100 on a sheet aligning and stacking portion 300B in a face-down state with their image surfaces facing down via a conveying portion, and align the sheets by right and left slide guides 301 and 302 (see FIG. 5) and bundle them for each predetermined job, and then bind the sheets at one or more locations thereof by the stapler H, and discharge and stack them on the discharged sheet stacking tray 325. Or the sheet post-treating apparatus 300 is adapted to discharge the sheet bundle onto the discharged sheet stacking tray 325 intactly in its face-down state without binding the sheet bundle.

The sheet post-treating apparatus 300 and the printer main body 100 are electrically connected together by a cable connector, not shown. Also, a casing portion 300A housing the various portions of the sheet post-treating apparatus 300 therein is detachably provided on the apparatus main body 100A of the printer main body 100 which will be described later.

The construction and operation of each portion of the printer main body 100 will now be described along the conveyance route of the sheet S conveyed.

In the printer main body 100, a plurality of sheets S are stacked in a feed cassette 200. The plurality of sheets are separated and fed one by one in order from the uppermost sheet by various kinds of rollers. A toner image is then transferred to the upper surface of the sheet S fed from the feed cassette 200 in an image forming portion 102 in the printer main body 100 for forming a toner image by an image forming process of the so-called laser beam type on the basis of a predetermined print signal supplied from the computer or the network. When the sheet has been fed into the image forming portion 102, a toner image is already formed on the photosensitive drum 103 of the image forming portion 102 by a toner in a cartridge K.

Subsequently, heat and pressure are applied to the sheet by a fixing device 120 on the downstream side, whereby the toner image thereon is permanently fixed. The sheet S with the image thereon thus fixed is selectively discharged to a face-down (FD) discharge area 125 provided in the upper portion of the printer main body 100 or to the discharged sheet stacking tray 325 of the sheet post-treating apparatus 300, depending on the position of the flapper 150 of the printer main body 100 changed over on the basis of a control signal from a control portion, not shown.

When the flapper 150, as shown in FIG. 1, is changed over to a broken-line position, the sheet is guided by the flapper 150 and is turned back by a substantially U-shaped sheet conveying path until it comes to a pair of discharge rollers 130, and has its image surface reversed and with the image surface facing down, the sheet is face-down-discharged from the printer main body 100 to the face-down discharge area 125 by the pair of discharge rollers 130.

Figure 2:
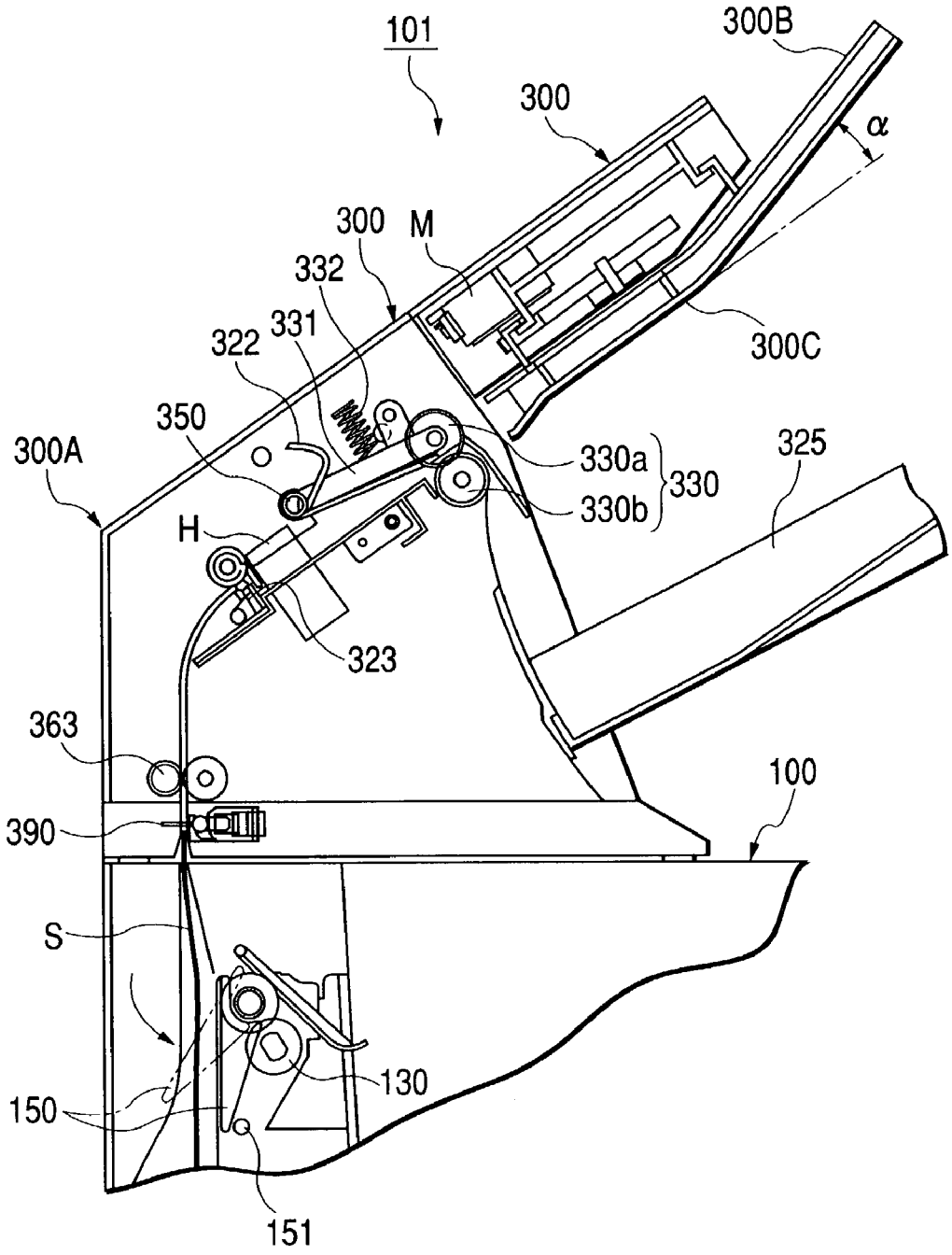
FIG. 2 illustrates the operation of the sheet post-treating apparatus which is the discharged sheet stacking apparatus of FIG. 1, and shows a state in which a sheet is fed into the sheet post-treating apparatus.

The printer 101 is designed such that when a stapling process is to be carried out on the basis of a command outputted in advance from the computer or the like, before the sheets S to be stapled are fed into the sheet post-treating apparatus 300 by the pair of discharge rollers 130, the flapper 150 is pivotally moved in a counter-clockwise direction from a broken-line position in FIG. 2 by a solenoid, not shown, through a link, not shown, and abuts against a stopper 151 and is stopped at a solid-line position, whereby the sheet is conveyed to the sheet post-treating apparatus 300.

Thus, the sheet S is conveyed to the entrance portion 390 of the sheet post-treating apparatus 300 by the guide of the flapper 150 and the rotation of the pair of discharge rollers 130 provided in the printer main body 100. The sheet S conveyed into the sheet post-treating apparatus 300 is detected by an entrance sensor 390. Thereafter, the sheet S is upwardly conveyed by a pair of entrance rollers 363.

The construction of the sheet post-treating apparatus 300 and the movement of each portion when the sheet S conveyed into the sheet post-treating apparatus 300 by the pair of discharge rollers 130 is conveyed to a sheet aligning and stacking portion 300B will now be described with reference to FIGS. 2 to 6.

Figure 3:
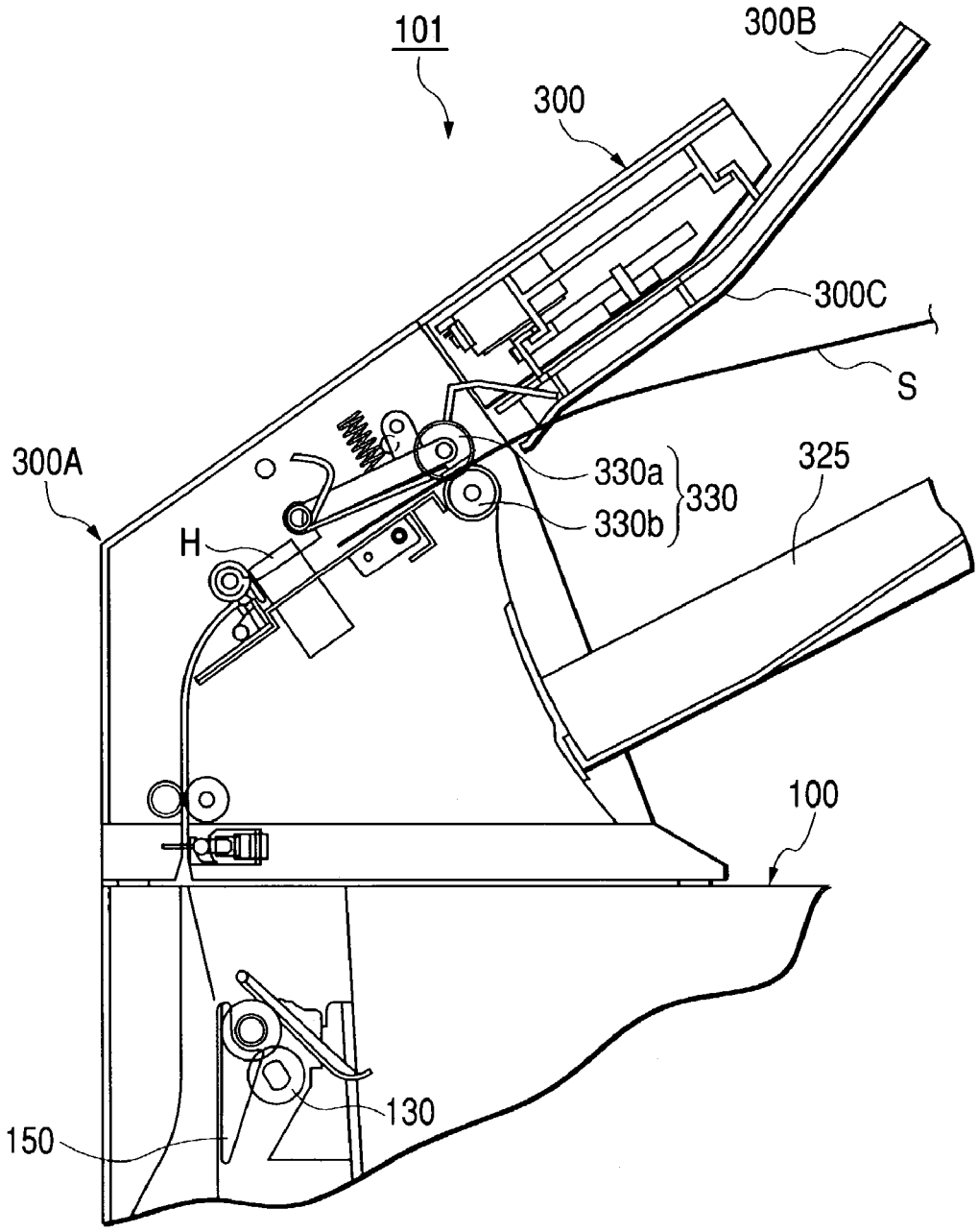
FIG. 3 illustrates the operation of the sheet post-treating apparatus which is the discharged sheet stacking apparatus of FIG. 1, and shows a state in which the sheet is discharged from the sheet post-treating apparatus.
Figure 4A:
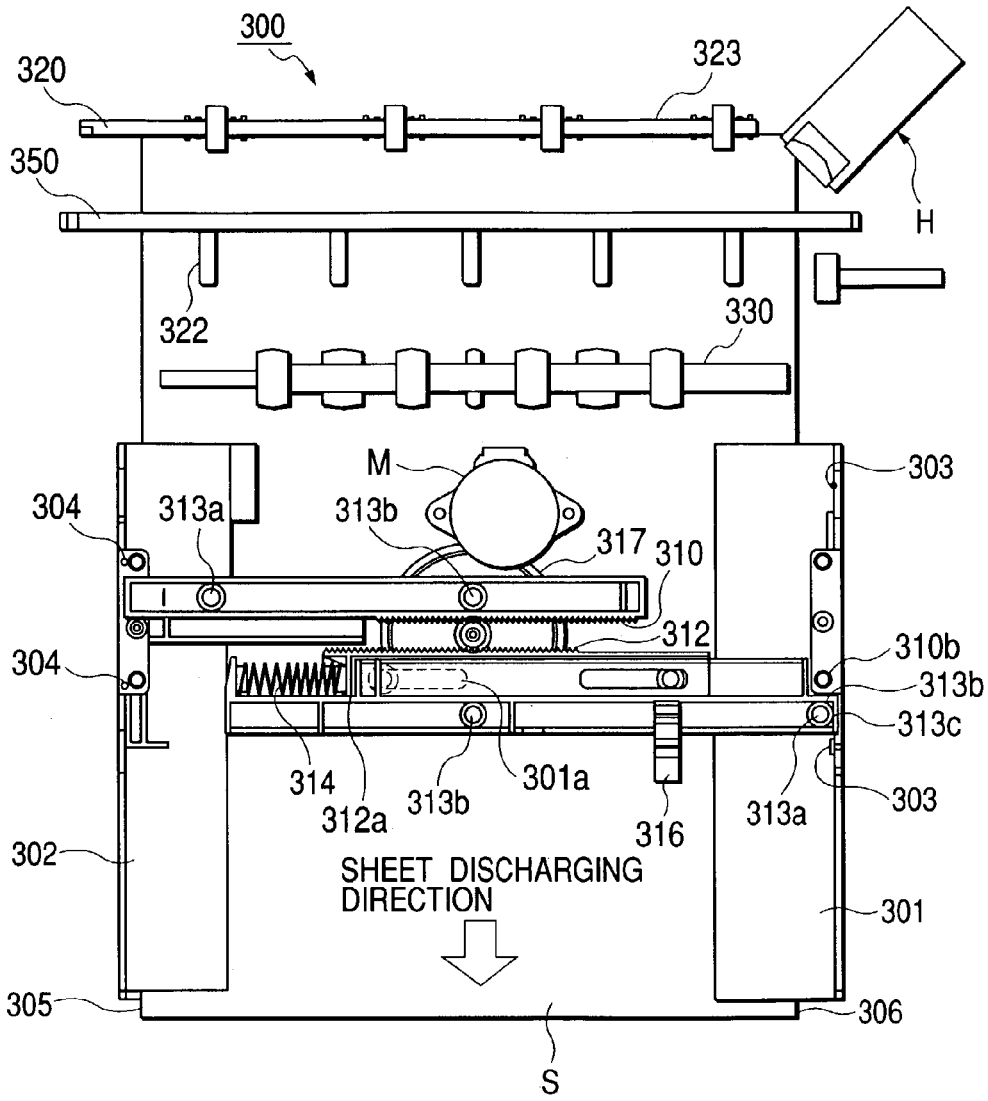
FIG. 4A illustrates the operation of the sheet aligning and stacking portion of the sheet post-treating apparatus which is the discharged sheet stacking apparatus of FIG. 1, and is a plan view in which a slide guide is in a standby position.
Figure 4B:
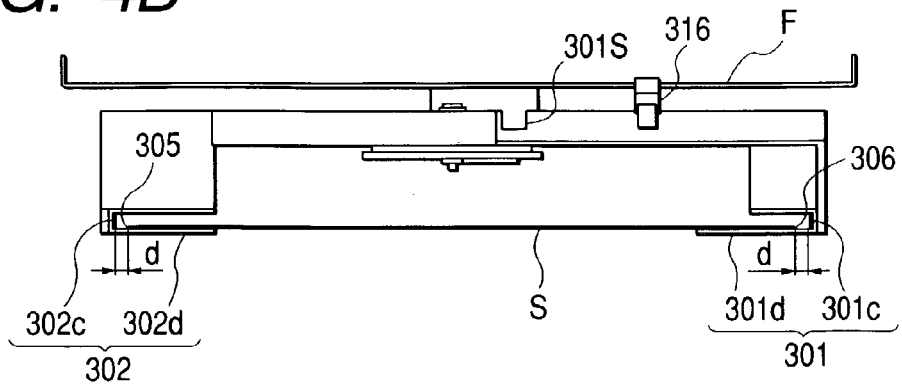
FIG. 4B is a view of the sheet aligning and stacking portion as it is seen from its downstream side end portion.

FIGS. 2 and 3 are cross-sectional views of the surrounding portion of the pair of discharge rollers 130 of the printer main body 100 and the sheet post-treating apparatus 300. FIG. 4A is a cross-sectional view of the sheet post-treating apparatus 300 of FIG. 1 taken along line 4A—4A of FIG. 1. FIG. 4B is a view of the right slide guide 301 and the left slide guide 302 as they are seen from the downstream side with respect to a sheet discharge direction.

As shown in FIG. 4A, the sheet post-treating apparatus 300 according to the present embodiment has the right slide guide 301 and the left slide guide 302 as guide members for effecting the alignment of the sheets in the widthwise direction thereof (a direction intersecting with a sheet conveying direction).

As shown in FIG. 2, a pair of rollers 330 comprised of a sheet discharge upper roller 330*a* and a sheet discharge lower roller 330*b* are disposed above the downstream side of the above-described flapper 150 with respect to the sheet conveying direction, and are adapted to be rotated by a driving motor, not shown.

Also, the sheet discharge upper roller 330*a* is journalled to a pivotally movable arm 331 pivotally biased in a clockwise direction about a paddle shaft 350 by a spring 332. A jog motor M is a motor for driving the right slide guide 301 (see FIG. 4A) and the left slide guide 302. It is preferable to use a stepping motor as the jog motor M.

A paddle 322 is made of a flexible material such as rubber, and a plurality of such paddles are fixed to the paddle shaft 350 in a direction perpendicular to the sheet conveying direction. The paddle 322 is adapted to move the sheet S in a direction opposite to the sheet conveying direction by the paddle shaft 350 being rotatively driven in a clockwise direction as viewed in FIG. 2, and make the upstream side and surface of the sheet S abut against a reference wall 323 to thereby align the upstream side end surface of the sheet S.

Description will now be made of the operation of the sheet post-treating apparatus 300 when the sheets are discharged and stacked on the discharged sheet stacking tray 325 in a face-down state.

Figure 6A:
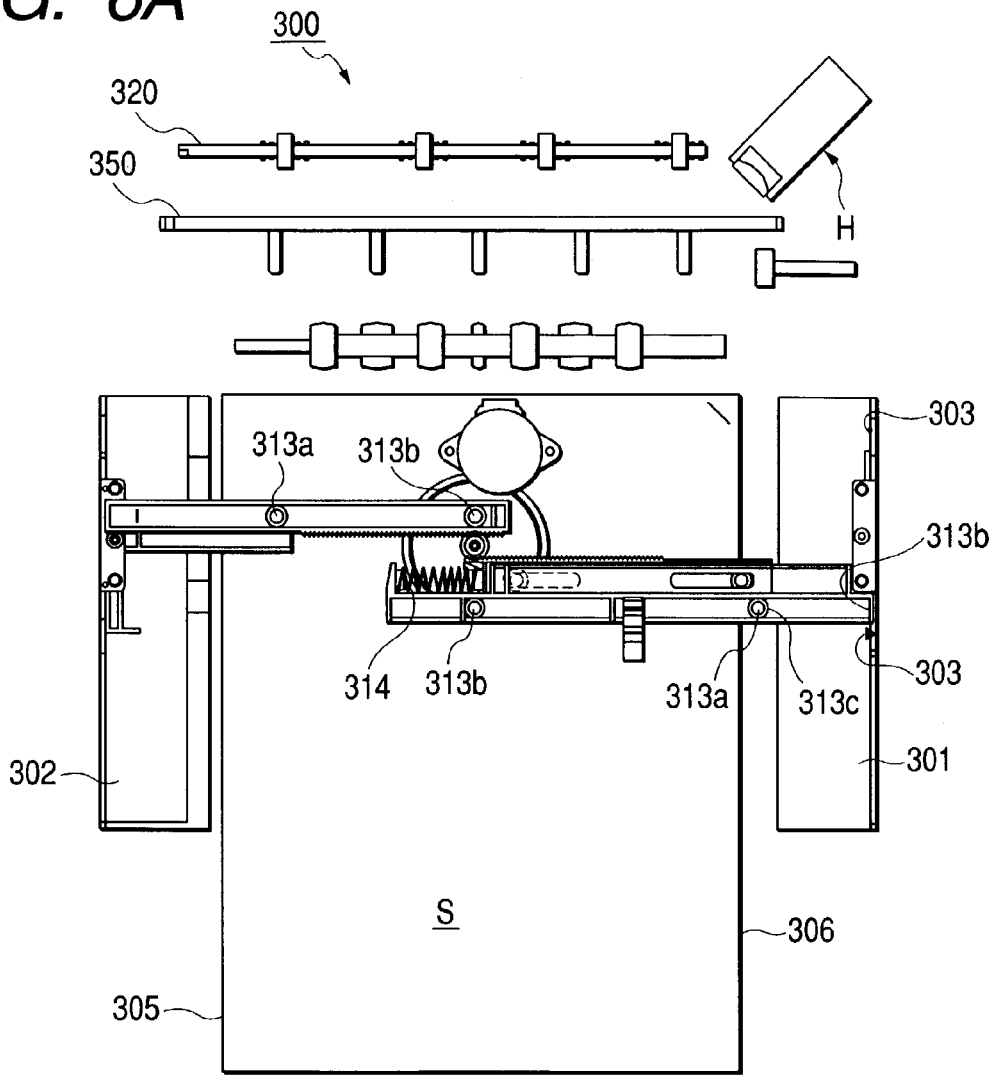
FIG. 6A illustrates the operation of the sheet aligning and stacking portion of the sheet post-treating apparatus which is the discharged sheet stacking apparatus of FIG. 1, and is a plan view showing a state in which the slide guide is in a home position and a sheet stack is falling.
Figure 6B:
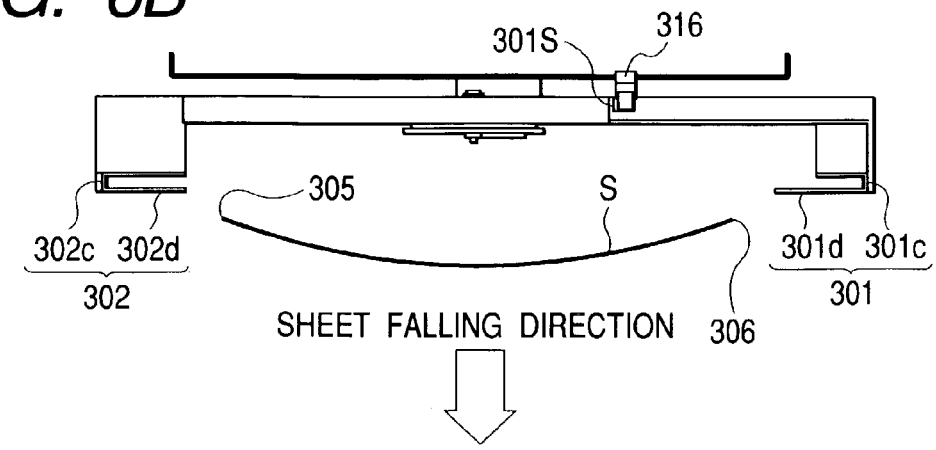
FIG. 6B is a view of the sheet aligning and stacking portion as it is seen from its downstream side end portion.
Figure 7:
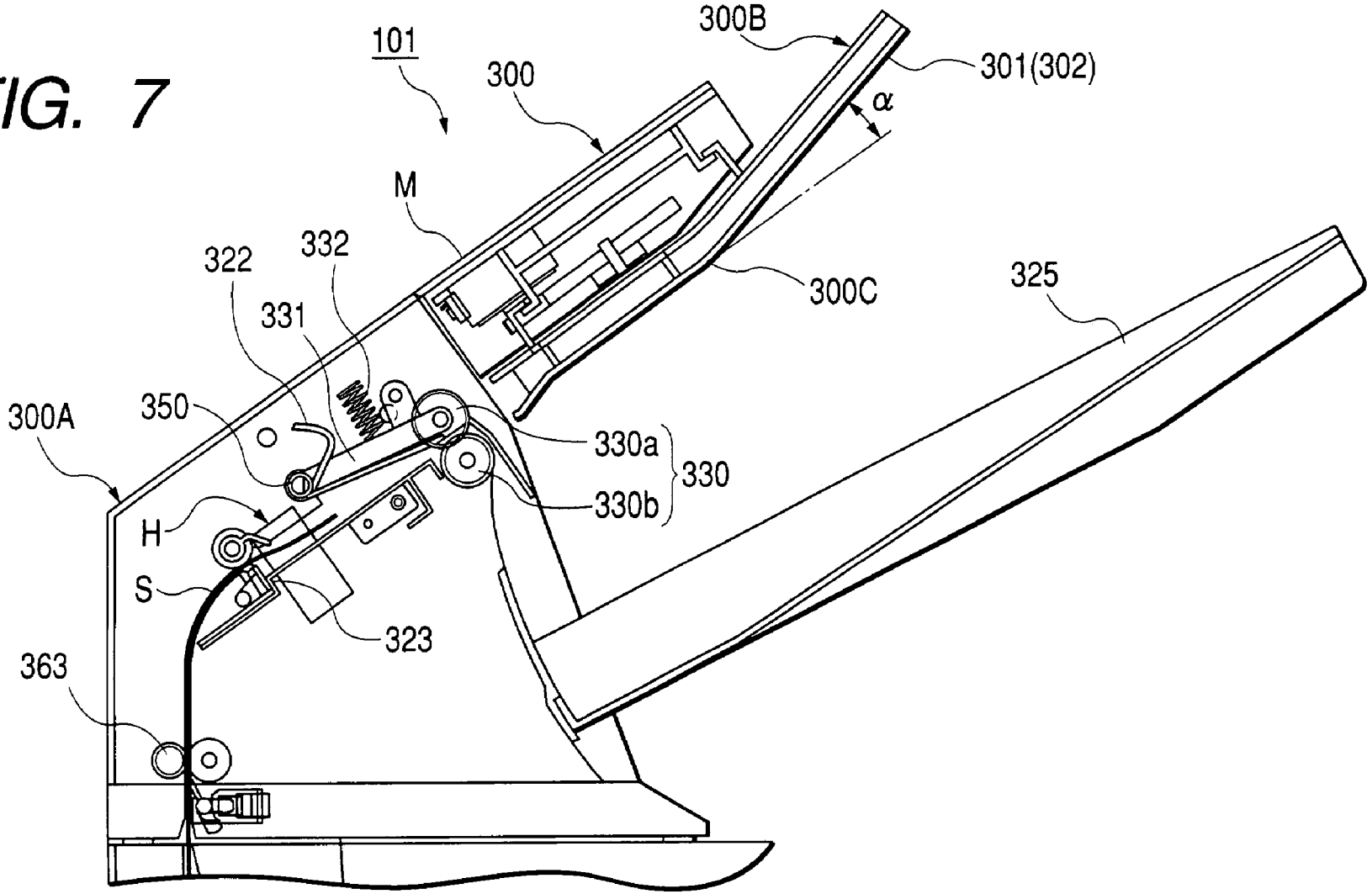
FIG. 7 shows a state in which the sheet has further been fed from the state of FIG. 2 into the sheet post-treating apparatus which is the discharged sheet stacking apparatus, and particularly shows a state in which the slide guide is in its waiting position.

As shown in FIGS. 6A and 6B, the sheet post-treating apparatus 300 is such that the bottom surfaces of the right slide guide 301 on the right side and the left slide guide 302 on the left side with respect to the sheet conveying-in direction are retracted to a position in which they do not abut against the sheet conveyed in, that is, a position outside the widthwise direction of the sheet S by a predetermined amount so that the sheet S can be discharged onto the discharged sheet stacking tray 325. Thereby, the sheet conveyed by the pair of entrance rollers 363 passes a pair of staple rollers 320 (see FIG. 4A), whereafter it passes through the opening of the stapler H and then is stacked on the discharged sheet stacking tray 325 by the pair of sheet discharge rollers 330 (see FIG. 3).

Description will now be made of the operation of the sheet post-treating apparatus 300 when the sheets are stapled and are discharged and stacked on the discharged sheet stacking tray 325.

As shown in FIG. 4A, the right slide guide 301 and the left slide guide 302 are retracted to a position outside the widthwise direction of the sheet S by a predetermined amount so that a right reference pin 303 provided on the wall surface of the right slide guide 301 on the right side with respect to the sheet conveying-in direction and the left reference pin 304 of the left slide guide 302 may not interfere with the sheet S (see FIG. 7) conveyed in. The interval between the end surfaces of the bottoms of the slide guides is at a position smaller than the width of the sheet S, and is adapted to wait for the entry of the sheet S. This position is referred to as the waiting position.

The sheet conveyed by the pair of entrance rollers 363 passes the pair of staple rollers 320, whereafter it passes through the opening of the stapler H, and then is conveyed by the pair of sheet discharge rollers 330, and is conveyed onto the guide surface of the sheet aligning and stacking portion 300B constituted by the right slide guide 301, the left slide guide 302, etc.

The guide surface of the sheet aligning and stacking portion 300B, as shown in FIG. 2, is inclined by a predetermined angle with respect to a horizontal direction, and differs in the angle of inclination between the upstream side and the downstream side with respect to the sheet conveying-in direction. Specifically, between a predetermined section on the upstream side and a predetermined section on the downstream side, there is formed a bent portion 300C bent at an angle of inclination $\alpha$. On the guide surface of the sheet aligning and stacking portion 300B, by having such a bent portion 300C, the flexure of the widthwisely central portion of the sheet S which is not guided by the slide guides 301 and 302 is prevented.

When the first sheet is conveyed onto a plane formed by the right slide guide 301 and the left slide guide 302, the arm 331 is rotated counter-clockwisely as viewed in FIG. 2 to thereby upwardly retract the sheet discharge upper roller 330*a* journalled to the arm 331. Simultaneously with the sheet discharge upper roller 330*a* separating from the sheet discharge lower roller 330*b*, the drive connected to the pair of sheet discharge rollers 330 is disconnected, and the sheet discharge upper roller 330*a* and the sheet discharge lower roller 330*b* are stopped from rotating. The sheet S, when its trailing edge completely leaves the pair of staple rollers 320, is returned in a direction opposite to the conveying direction by gravity, and is moved toward the reference wall 323. At the same time, the paddle 322 is rotated in a clockwise direction (the direction of arrow) as viewed in FIG. 8 by the paddle shaft 350 to thereby move the sheet S in a direction opposite to the sheet conveying direction, and make it abut against the reference wall 323, thus aligning the upstream side end surface of the sheet S.

Figure 5A:
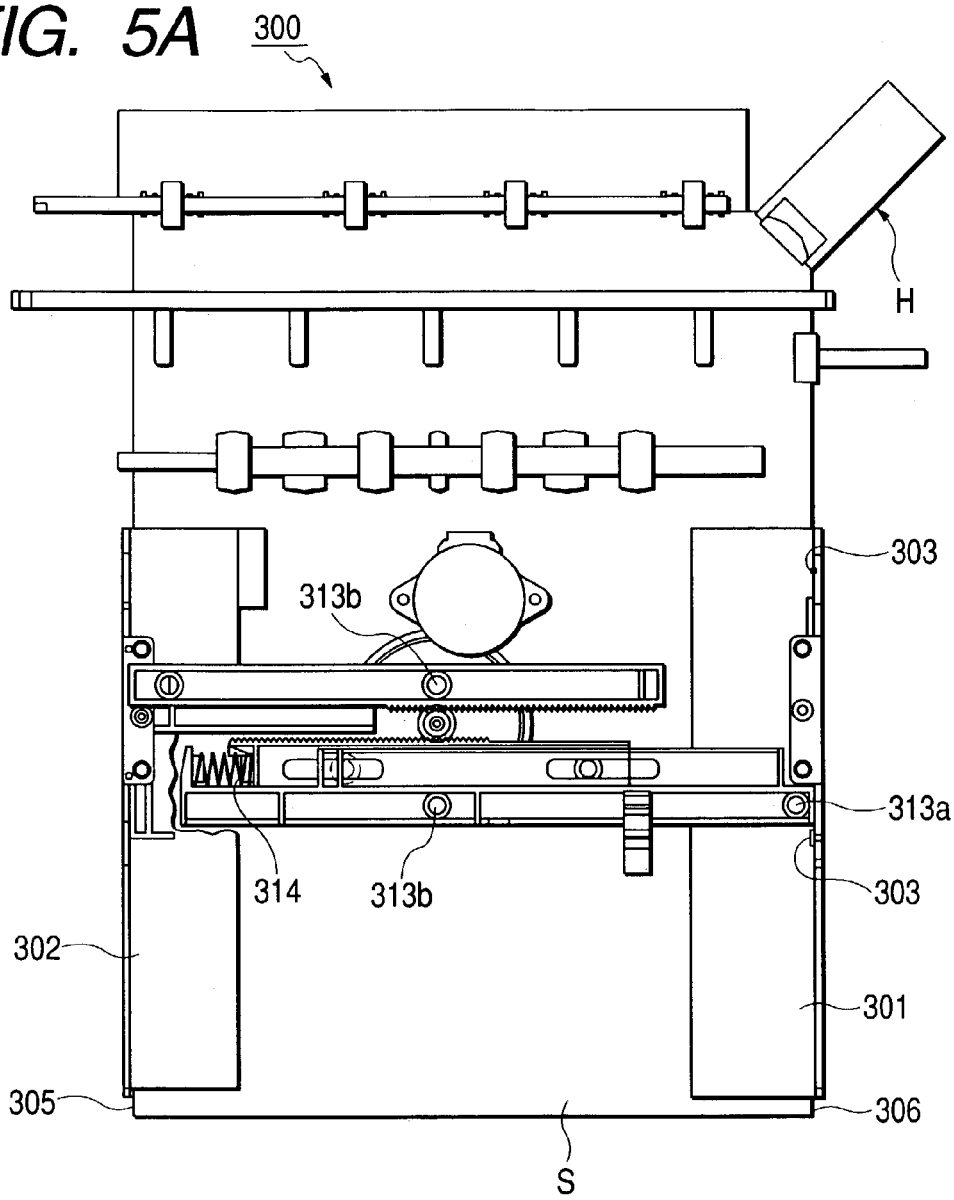
FIG. 5A illustrates the operation of the sheet aligning and stacking portion of the sheet post-treating apparatus which is the discharged sheet stacking apparatus of FIG. 1, and is a plan view showing a state in which the slide guide has aligned sheets.
Figure 5B:
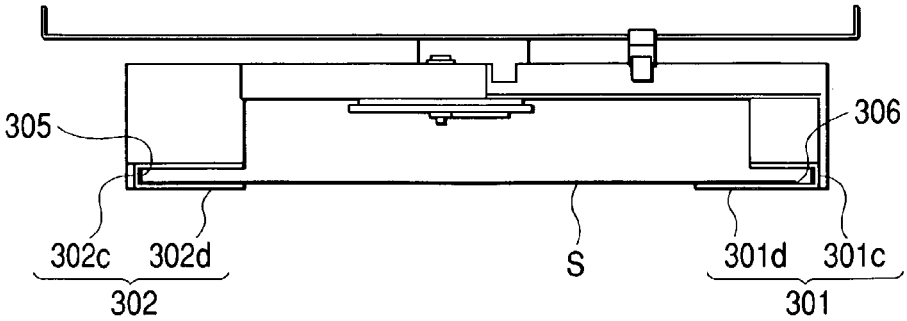
FIG. 5B is a view of the sheet aligning and stacking portion as it is seen from its downstream side end portion.

Next, only the left slide guide 302 on the left side is operated to thereby start the operation of widthwisely aligning the sheets stacked on the sheet aligning and stacking portion 300B. Specifically, the left slide guide 302 is driven by the motor M and is moved to the right side in FIG. 4A by a desired amount of alignment in conformity with an input signal from the printer main body 100 regarding a sheet size. Then, as shown in FIGS. 5A and 5B, the left slide guide 302 pushes the left side 305 of the sheet S by a left reference pin 304 provided on the left side guide 302 and pushes the sheet S to the right slide guide 301 side.

Then, the right side 306 of the sheet S strikes against a right reference pin 303 provided on the right slide guide 301, whereby the widthwise alignment of the sheets is effected. Thus, the sheets S are moved to a set staple position at a position in which they abut against the right reference pin 303 and are aligned thereby, and are stapled (bound) at that position by the stapler H.

Figure 9:
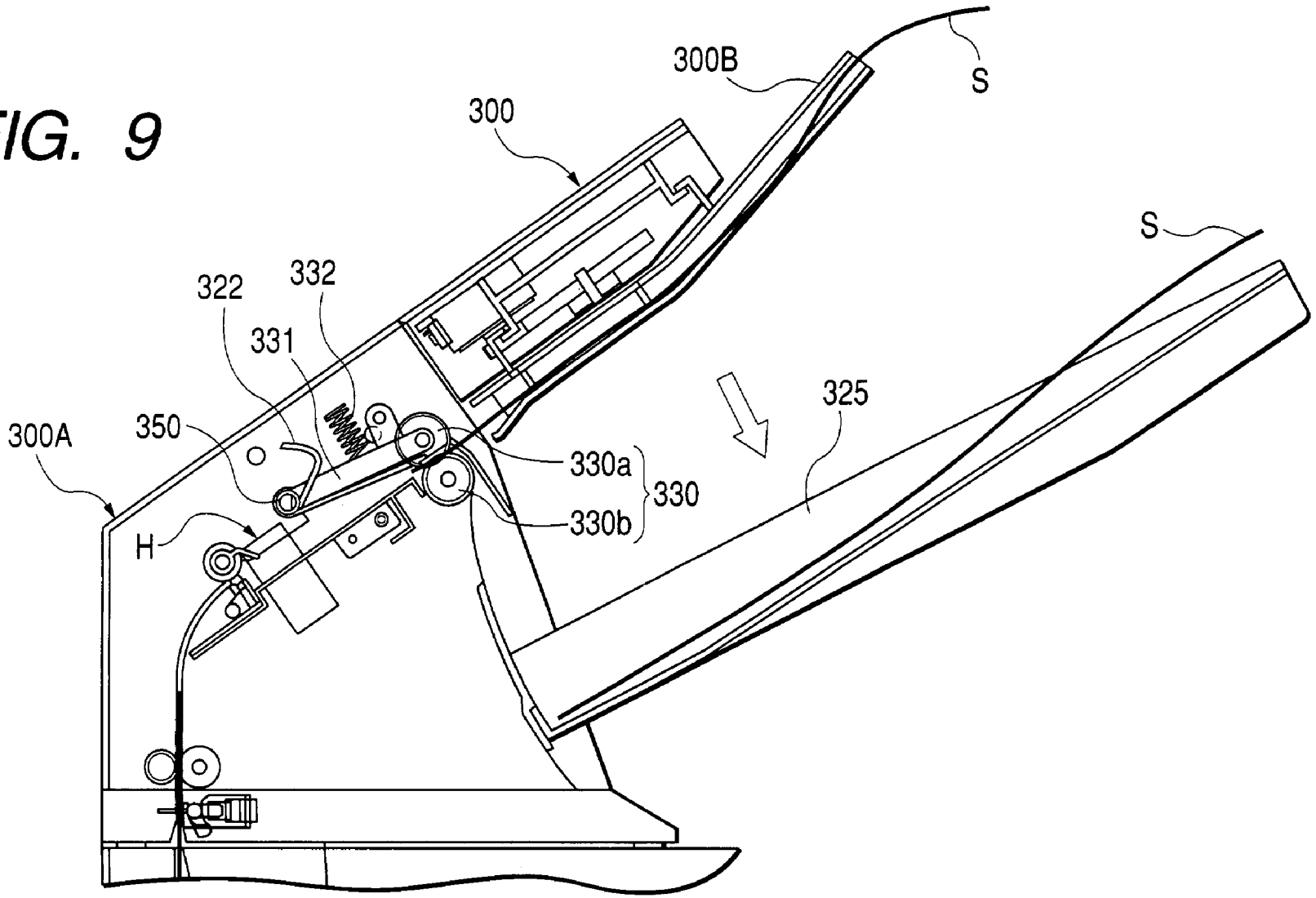
FIG. 9 shows a state in which the sheet is discharged onto a discharged sheet stacking tray.

The stapled sheets S, as shown in FIG. 9, are conveyed toward the downstream side away from the stapler H by a pair of rollers 330. Then, as shown in FIGS. 6A and 6B, the left slide guide 302 is moved in a direction to widen from the width of the sheets S and is made capable of coping with the conveyance of the next sheet again in the waiting position. The right slide guide 301 is also moved rightwardly. As a result, the bound sheet bundle, as shown in FIG. 9, falls from the sheet aligning and stacking portion 300B onto the discharged sheet stacking tray 325.

The construction of the slide guides 301 and 302 of the sheet aligning and stacking portion 300B will now be described in detail.

FIG. 4A illustrates the construction of the slide guides of which a cross-section along line 4A—4A of FIG. 1 is shown. Also, FIGS. 5A, 5B, 6A and 6B illustrate the operation of the slide guides.

The slide guides 301 and 302 are adapted to be guided by four guide pins in total, i.e. two guide pins 313*a* provided on a mold frame and two guide pins 313 provided on a metal plate frame F, and be reciprocally moved in left and right directions as viewed in FIG. 4A, i.e., a direction (the widthwise direction of the sheet) perpendicular to the sheet conveying direction, by a driving force from the jog motor M.

The slide guides 301 and 302, when viewed from downstream with respect to the sheet conveying direction, as shown in FIG. 4B, are formed into a substantially U-shaped cross-section by wall portions 301*c* and 302*c* for guiding the opposite sides of the sheet S and supporting portions 301*d* and 302*d* supporting the upper and lower surfaces of the sheet S. Each sheet discharged onto the sheet aligning and stacking portion 300B is supported by this U-shaped lower surface, and the widthwisely central portion of the sheet S is adapted not to be guided (supported).

The left slide guide 302 is provided with a spur-gear-shaped left slide rack portion 310 meshing with a stepped gear 317. On the other hand, the right slide guide 301 is also provided with a spur-gear-shaped right slide rack portion 312 meshing with the stepped gear 317. The right slide rack portion 312 is provided for movement relative to the right slide guide 301 through a coil-shaped spring 314. The spring 314 has its one end side abutting against the right slide guide 301 and has its other end side abutting against the right slide rack portion 312, and biases the right slide guide 301 and the right slide rack portion 312 in a direction to widen them. Also, the right slide rack portion 312 has an embossed portion 312*a* movable in a square hole portion 301*a* on the right slide guide 301 side.

Two metallic right reference pins 303 excellent in wear resistance are provided on the side wall of the right slide guide 301. Two metallic left reference pins 304 excellent in wear resistance are also provided on the side wall of the left slide guide 302. When the sheets are to be aligned, the left slide guide 302 is adapted to be moved so that the left reference pin 304 and the right reference pin 303 may abut against the opposite side edge surfaces 305 and 306, respectively, of the sheet. The right slide guide 301 and the left slide guide 102 have their height directions supported by the stepped gear 317 and a jog metal plate frame.

Referring to FIGS. 4A, 4B, 5A, 5B, 6A and 6B, the stapler H is fixedly disposed on the right slide guide 301 side in order to effect stapling in the left upper corner portion of the image surface of sheets on which images have been formed to thereby bind the sheets. FIG. 4A is a view of the sheet aligning and stacking portion 300B as it is seen from below it and thus, the sheets are seen in their reversed state. Accordingly, in FIG. 4A, the staple H looks like stapling the right upper portions of the sheets, but actually it is adapted to staple the left upper portions of the sheets.

The operations of the slide guides 301 and 302 will now be described in detail.

When electric power is supplied to the sheet post-treating apparatus 300, the pair of stapler rollers 320 driven by the driving motor start to be rotated and next, the jog motor M is rotated and the stepped gear 317 is rotated, whereby the left slide rack portion 310 of the left slide guide 302 is driven and retracted to the outside. As regards the right slide guide 301, when the jog motor M is rotated and the stepped gear 317 is rotated, the right slide rack portion 312 is first relatively moved and the embossed portion 312*a* of the right slide rack portion 312 abuts against the right end surface of the square hole portion 301*a* of the right slide guide 312*a* as viewed in FIG. 4A, whereafter it is pressed by the embossed portion 312*a*, whereby it is retracted to the outside.

The right slide guide 301 is provided with a slit portion 301S, and when the slit portion 301S is moved to a predetermined retraction distance, a photosensor 316 transmits light therethrough as shown in FIG. 6A, and at that point of time, the jog motor M is stopped. This position is referred to as a home position.

When a signal by which the sheet S enters the sheet post-treating apparatus 300 is inputted from the printer main body 100 to the sheet post-treating apparatus 300, the jog motor M is rotated, and the right slide guide 301 and the left slide guide 302 are moved to the inside, and are stopped at a position wider by a predetermined amount d than the width of the sheet S, as shown in FIGS. 4A and 4B. At this position, the right slide guide 301 has its stopper 301*b* abutting against the end surface 313*c* of a guide pin 313*a* and becomes incapable of being further moved to the inside. This position shown in FIGS. 4A and 4B is referred to as a waiting position, and in this position, the side of the right slide guide 301 becomes a reference position during the aligning operation.

When a sheet narrower in width than this is to be aligned by the sheet post-treating apparatus 300, the left slide guide 302 is moved to the right by an amount corresponding to this, whereby in FIG. 4B at the waiting position, the left gap always assumes a predetermined amount d. In this case, the gap between such sheet and the left slide guide 302 widens by a half of an amount narrower than the predetermined amount d.

Even when the size (width) of the sheet S is a passable maximum size, the waiting positions of the right slide guide 301 and the left slide guide 302 are set so that the gaps on the opposite sides may assume predetermined amounts d, d, respectively.

Figure 8:
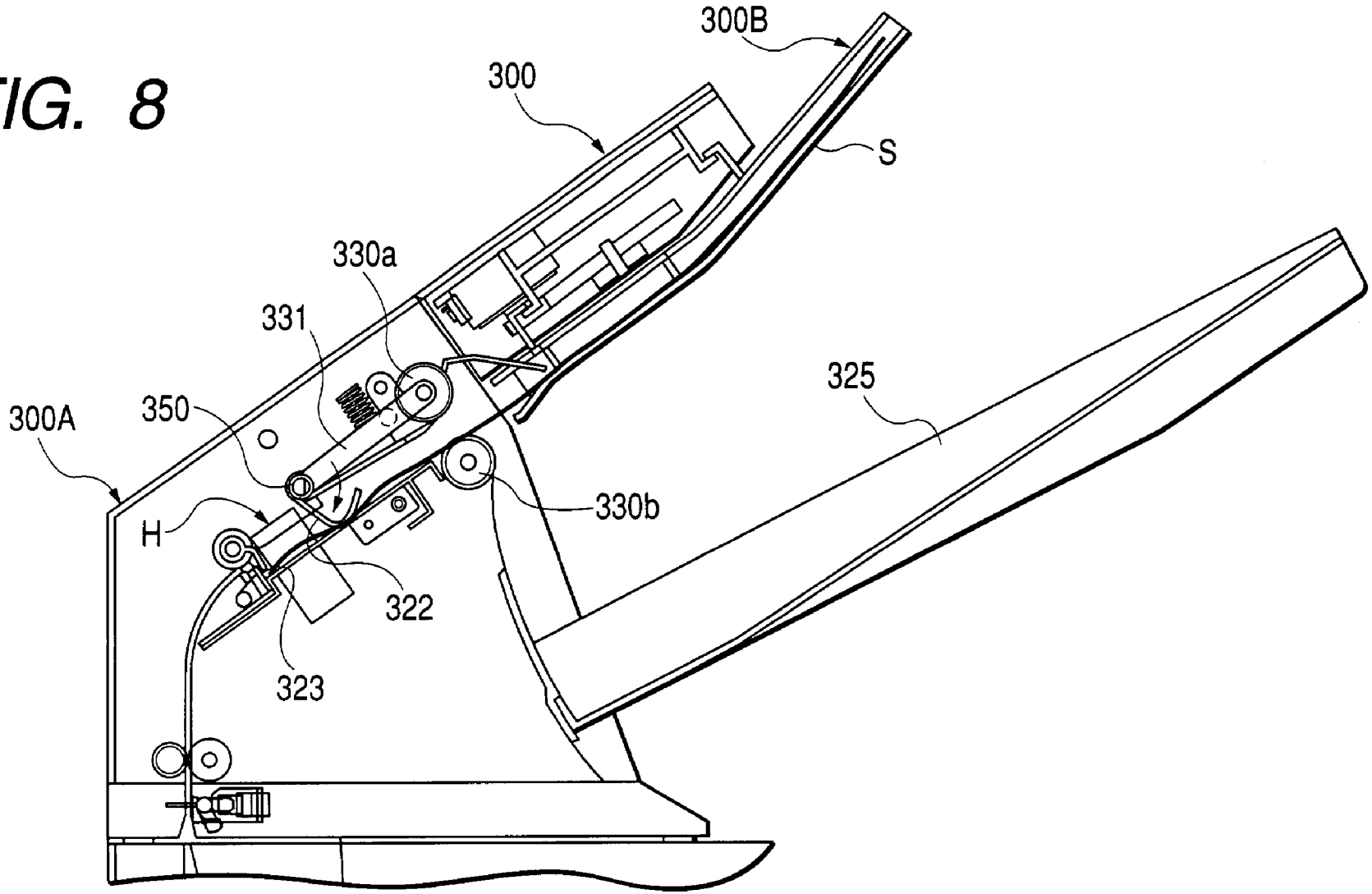
FIG. 8 shows a state in which the upstream side end portion of the sheet is aligned from the state of FIG. 7.

Thereafter, as shown in FIG. 8, the paddle 322 makes one full rotation clockwisely about the paddle shaft 350 and abuts against the upper surface of the sheet S to thereby ram the sheet S against the reference wall 323.

By these operations, the alignment of the sheet in the sheet conveying direction and a direction perpendicular to the sheet conveying direction becomes possible. In order to keep this aligned state, a lever provided with a frictional member near the right end surface of the aligned sheet has stamp means vertically moved to thereby press the aligned sheet, and after the aligning operation has been terminated and before a sheet entering next abuts against the aligned sheet, the lever presses the upper surface of the sheet to thereby prevent the next sheet from moving the aligned sheet.

Subsequently, the second and subsequent sheets will be described. During the conveyance of the second and subsequent sheets, the pair of sheet discharge rollers 330 are spaced apart from each other and therefore, when the trailing edge of the sheet S completely leaves the pair of staple rollers 320, the sheet is returned in a direction opposite to the conveying direction by gravity and is moved toward the reference wall 323.

The aligning operation thereafter is entirely similar to that for the first sheet and therefore need not be described.

Such an operation is repetitively performed and the operation of aligning the last (nth) sheet (Sn) in a job is performed, and in the state of FIGS. 4A and 4B in which each left reference pin 304 provided on the left slide guide 302 rams the left side of the sheet against each right reference pin 303 of the right slide guide 301, and the movement of the left slide guide 301 is stopped, the sheet bundle is stapled by the small stapler H.

According to the sheet post-treating apparatus 300 of the present embodiment, during the aligning operation for each sheet, the right slide guide 301 is stopped at the reference position and is not moved, and only the left slide guide 302 is moved and the left end portions of the sheets are all present at the reference position and therefore, the binding process by the stapler H fixedly disposed on the right slide guide 301 side is carried out accurately and reliably. Further, even when the widths of sheets conveyed in at a job are unequal or when in a job, the sheet size changes, for example, from LTR size to A4 size, the position of the left end portions of the sheets can be made constant and therefore, the finish of the binding process by the stapler H becomes accurate and neat, and an excellent effect can be obtained.

When the stapling operation is terminated in the manner described above, the jog motor M is rotatively driven and the left slide guide 302 is moved in a direction to widen from a position shown in FIGS. 5A and 5B. At the start of this movement of the left slide guide 302, the right slide rack portion 312 on the right slide guide 301 side is moved to the right as viewed in FIGS. 6A and 6B and therefore, the right slide guide 301 itself is not moved immediately.

When the position of the left slide guide 302 passes the waiting position shown in FIGS. 4A and 4B, the embossed portion 312*a* of the right slide rack portion 312 abuts against the end surface of the square hole portion 301*a* of the right slide guide 301, and the right slide guide 301 starts to be moved to the right as viewed in FIGS. 4A and 4B, and the two slide guides 301 and 302 are moved.

Further, the stapled sheet bundle falls downwardly as indicated by arrow in FIGS. 6A, 6B and 9 when the interval between the two slide guides 301 and 302 by which the sheet bundle is supported becomes approximate to or wider than the width of the sheet. Thereby, the sheet bundle falls onto and is stacked on the discharged sheet stacking tray 325 of the sheet post-treating apparatus 300.

The foregoing is the description of the construction and operation of the printer main body 100 and the sheet post-treating apparatus 300.

The mechanism of the discharged sheet stacking tray 325 of the sheet post-treating apparatus 300 will now be described with reference to FIGS. 10 to 14. Each of these figures is a cross-sectional view of the sheet post-treating apparatus according to the present embodiment taken along the sheet conveying direction.

Figure 10:
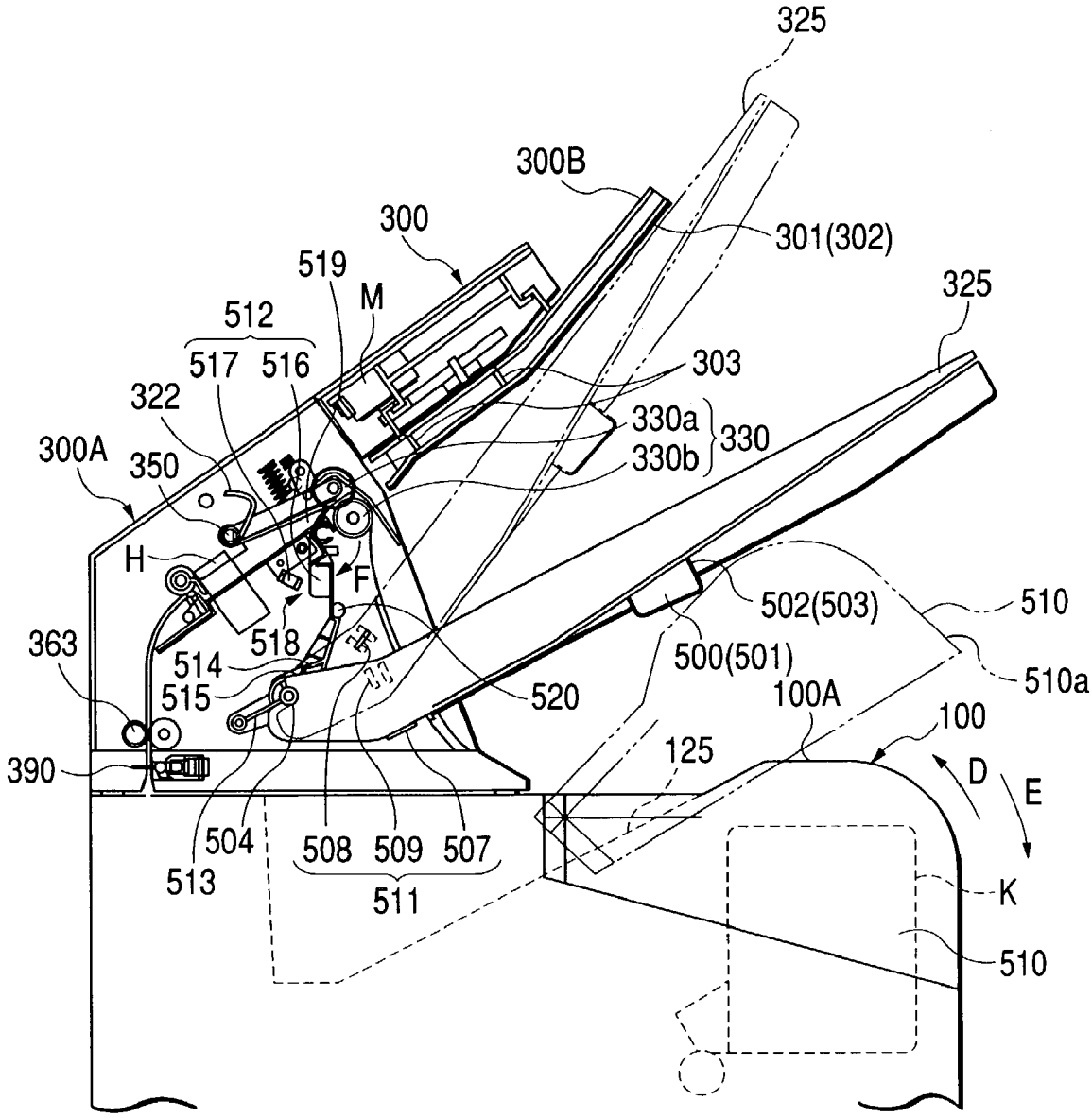
FIG. 10 is a cross-sectional view of the printer which is the image forming apparatus of FIG. 1 provided with a position detecting portion.
Figure 11:
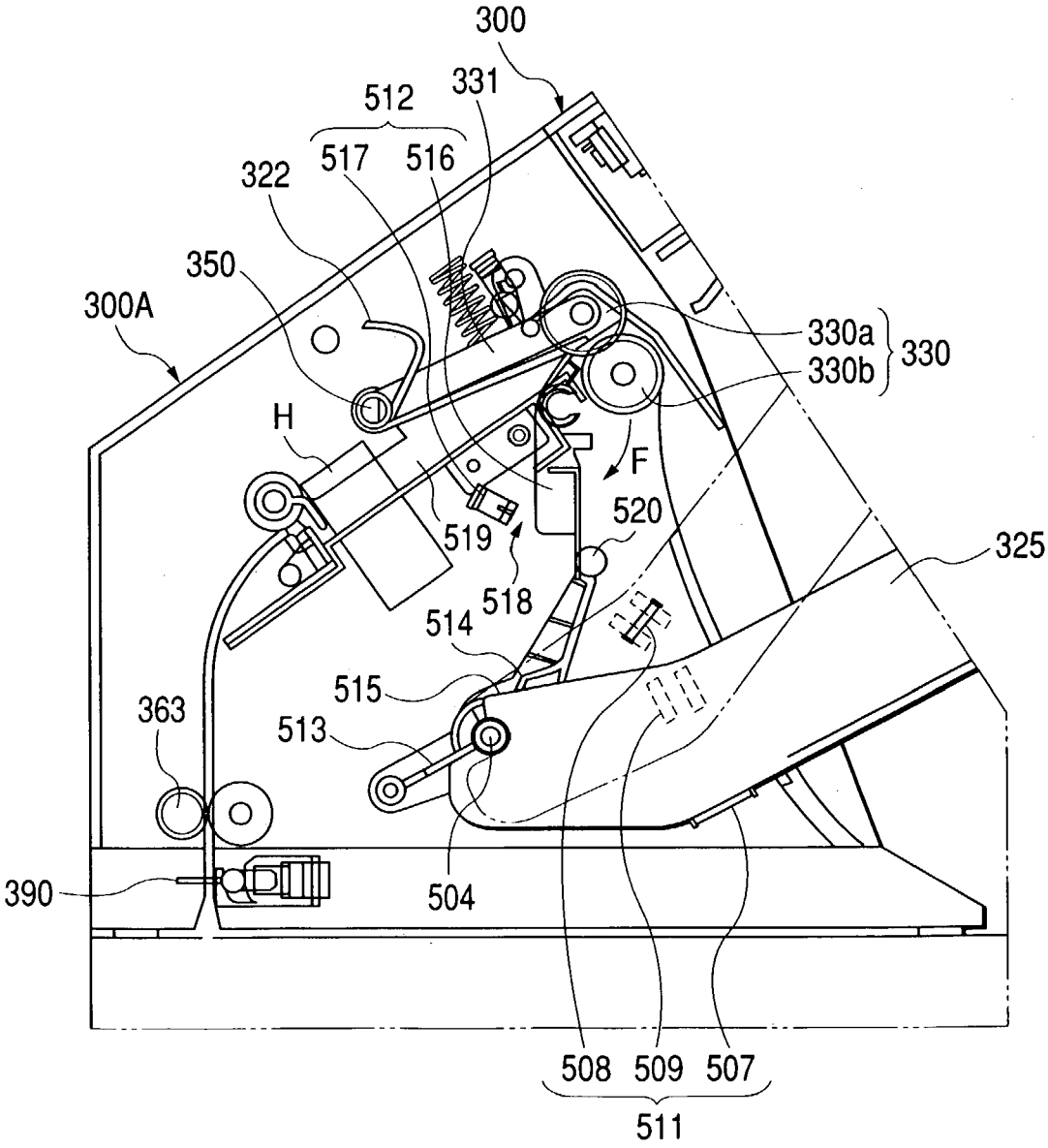
FIG. 11 is an enlarged view of the surroundings of the position detecting portion of FIG. 10.

As shown in FIG. 10, the discharged sheet stacking tray 325 has a right rib 500 detachably mountable on the underside near the side rib of the discharged sheet stacking tray 325 and a left rib 501 of the same shape, not shown, on this side. A high molecular polymer sheet 502 of a low coefficient of friction is attached to the outer surface of the right rib 500. A left high molecular polymer sheet 503, not shown, is attached to the outer surface of the left rib 501.

The discharged sheet stacking tray 325 is adapted to be pivotally moved about a fulcrum 504 within the range of a first position indicated by solid line in which it stacks the sheets thereon and a second position indicated by broken line in which it does not stack the sheets thereon. A holding piece 507 is a member for receiving the discharged sheet stacking tray 325 and holding it in the first position. A holding member 508 is a member for holding the discharged sheet stacking tray 325 in the second position. The holding piece 507 and the holding member 508 are provided on a casing portion 300A. A stopper member 509 is provided on the discharged sheet stacking tray 325 and is adapted to be engaged with the holding member 508. The fixing member or the fixing part of the laser beam printer 101 may be used in lieu of the holding piece 507.

The holding piece 507, the holding member 508 and the stopper member 509 are disposed at locations on the opposite sides of the discharged sheet stacking tray 325. Also, since the stopper member 509 is adapted to be engaged with the holding member 508, at least one of these two members has elasticity and is adapted to be engaged with and disengaged from the other by elastic deformation. Alternatively, it is adapted to frequent relative to an attached portion, and is adapted to be engaged with and disengaged from the other by the discharged sheet stacking tray 325 being pivotally moved against the frequenting-force thereof.

Description will now be made of the handling of the sheet post-treating apparatus 300 during the user's jam treatment, the maintenance of the apparatus main body 100A and the interchange of the cartridge.

Figure 13:
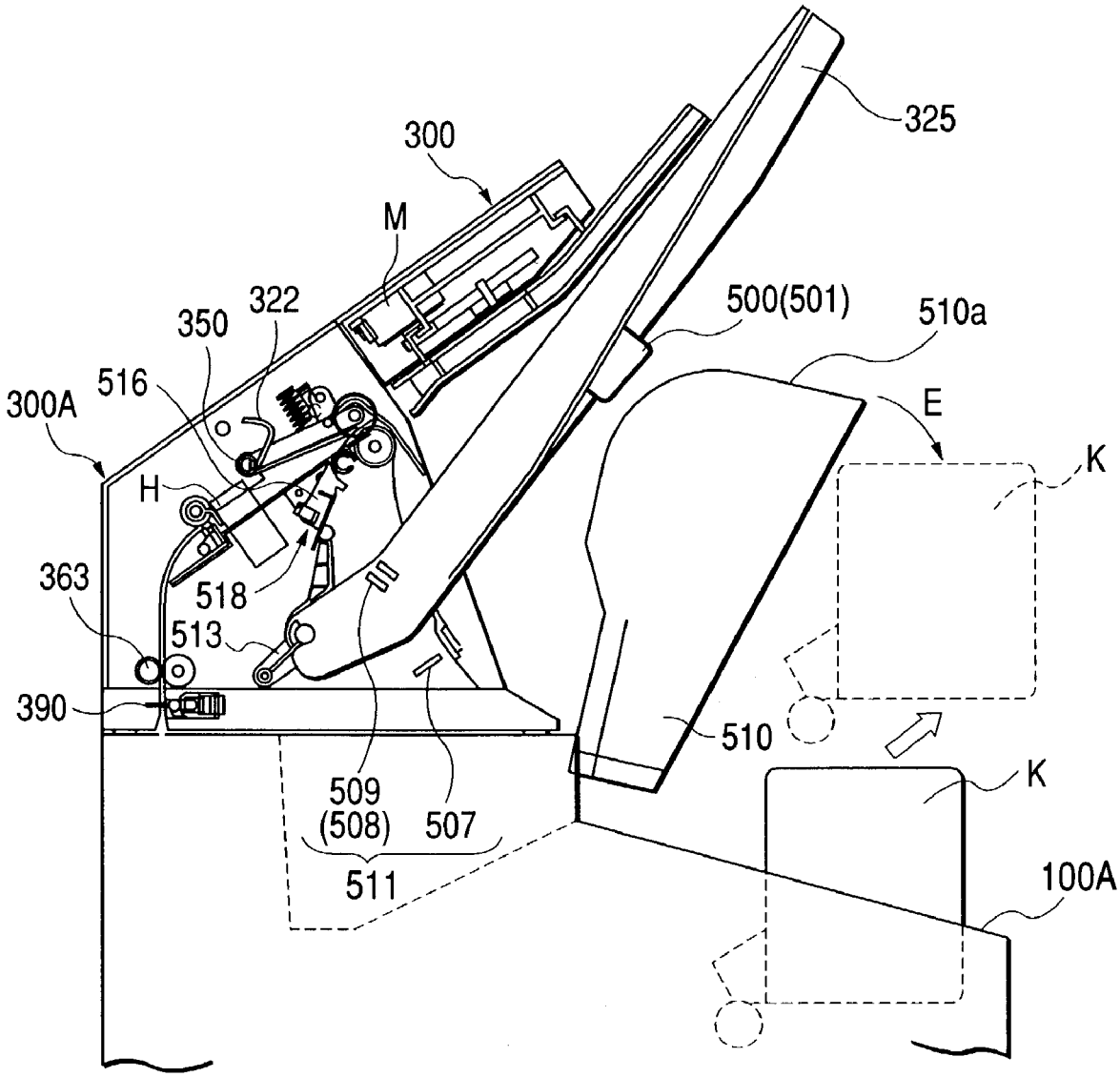
FIG. 13 is a cross-sectional view illustrating the operation of the slide guide in the first embodiment, and shows a state in which the discharged sheet stacking tray is raised to the second position and the cartridge cover is stopped at a predetermined position.

A cartridge cover 510 is a cover opened and closed when the user effects jam treatment and the interchange of the cartridge K. The cartridge cover 510, when it is rotated in the direction of arrow D and clears a predetermined angle, is locked by a lock mechanism, not shown, and is held in a state in which the apparatus main body 100 is opened, as shown in FIG. 13, and is adapted not to be lowered in the direction of arrow E from the lock point thereof by gravity. Accordingly, the cartridge cover 510 is designed so as not to hinder such work as the user's jam treatment, maintenance and the interchange of the cartridge with the apparatus main body 100 opened.

The operation of opening the cartridge cover 510 will now be described.

When the user opens the cartridge cover 510 by a predetermined angle, as indicated by broken line in FIG. 10, the outer peripheral surface 510*a* of the cartridge cover 510 comes into contact with the right high molecular polymer sheet 502 of the right rib 500 and the left high molecular polymer sheet 503 of the left rib 501, of the overlying discharged sheet stacking tray 325. The cartridge cover 510 is adapted not to contact with the other portions of the discharged sheet stacking tray 325 than the right high molecular polymer sheet 502 and the left high molecular polymer sheet 503.

When the user further opens the cartridge cover 510 in the direction of arrow D, the right rib 500 and the left rib 501 begin to slide on the outer peripheral surface 510*a* of the cartridge cover 510. The discharged sheet stacking tray 325 is pushed by the cartridge cover 510 and begins to be pivotally moved from the first position indicated by solid line toward the second position indicated by broken line. The cartridge cover 510 is designed to be further pivotally movable from a predetermined lock point.

Figure 12:
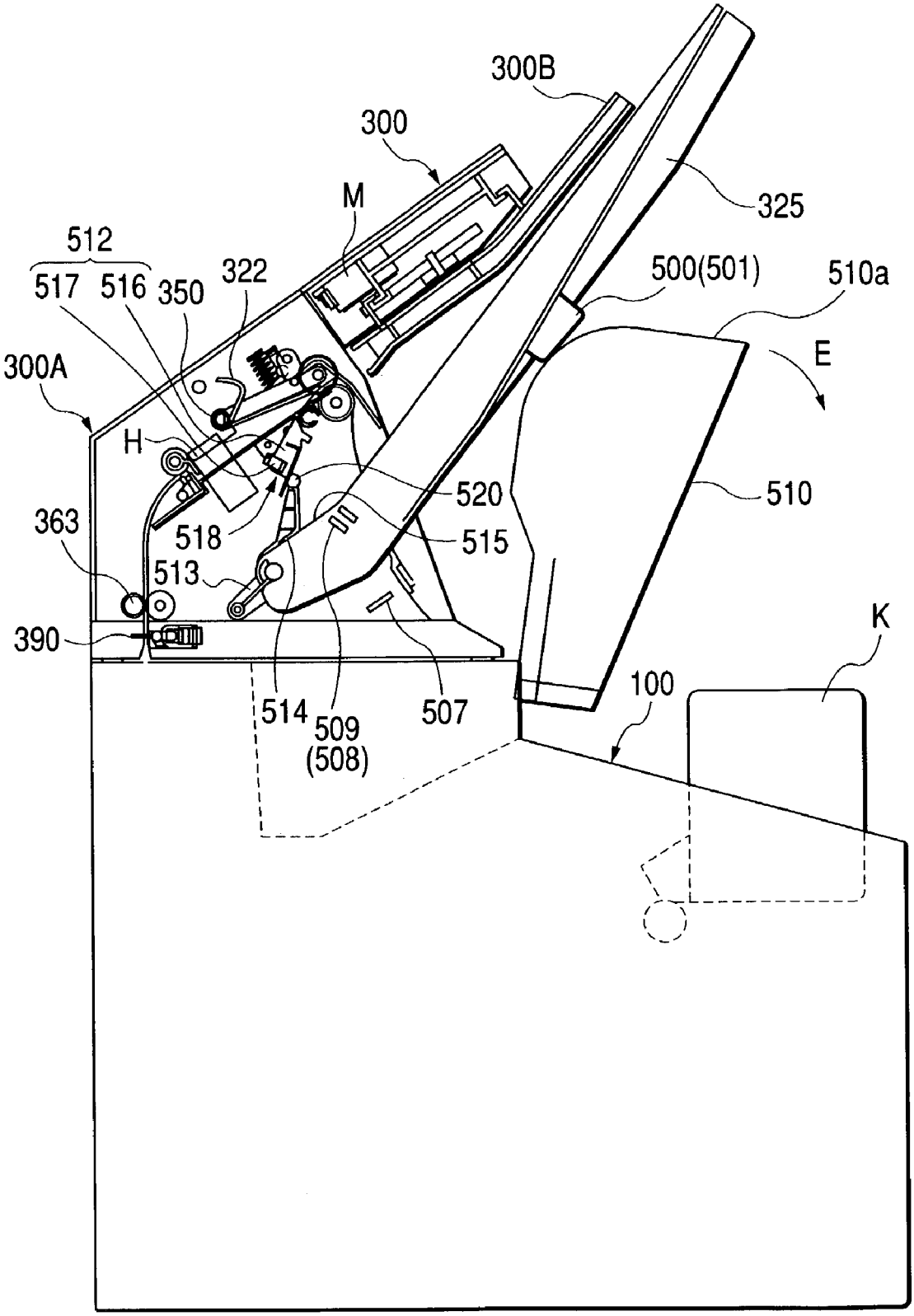
FIG. 12 shows a state in which in FIG. 10, a cartridge cover is opened and the discharged sheet stacking tray is raised to a second position.

When the cartridge cover 510 is further pivotally moved, as shown in FIG. 12, the discharged sheet stacking tray 325 comes to the second position and the stopper member 509 on the discharged sheet stacking tray 325 side once clears the holding member 508 and comes into engagement with the holding member 508, and holds the latter in the second position. At that point of time, the discharged sheet stacking tray 325 is held in the second position by the engagement of the stopper member 509 with the holding member and thus, is not lowered toward the first position by gravity.

When the user releases the cartridge cover 510, it is downwardly pivotally moved to a predetermined angle by gravity and is locked by the lock mechanism, not shown, and is held in a state in which the apparatus main body 100A is opened, as shown in FIG. 13. At this time, the cartridge cover 510 is adapted to separate from the right rib 500 and left rib 501 of the discharged sheet stacking tray 325 so that the load of the discharged sheet stacking tray 325 may not be applied to the cartridge cover 510.

The user effects such work as sheet jam treatment, the maintenance of the apparatus main body 100A and the interchange of the cartridge K in the state as shown in FIG. 13 wherein the apparatus main body 100A is opened by the cartridge cover 510.

The discharged sheet stacking tray 325 may be upwardly pivotally moved singly and earlier than the cartridge cover 510 and be held in the second position.

The operation of closing the cartridge cover 510 will now be described.

Figure 14:
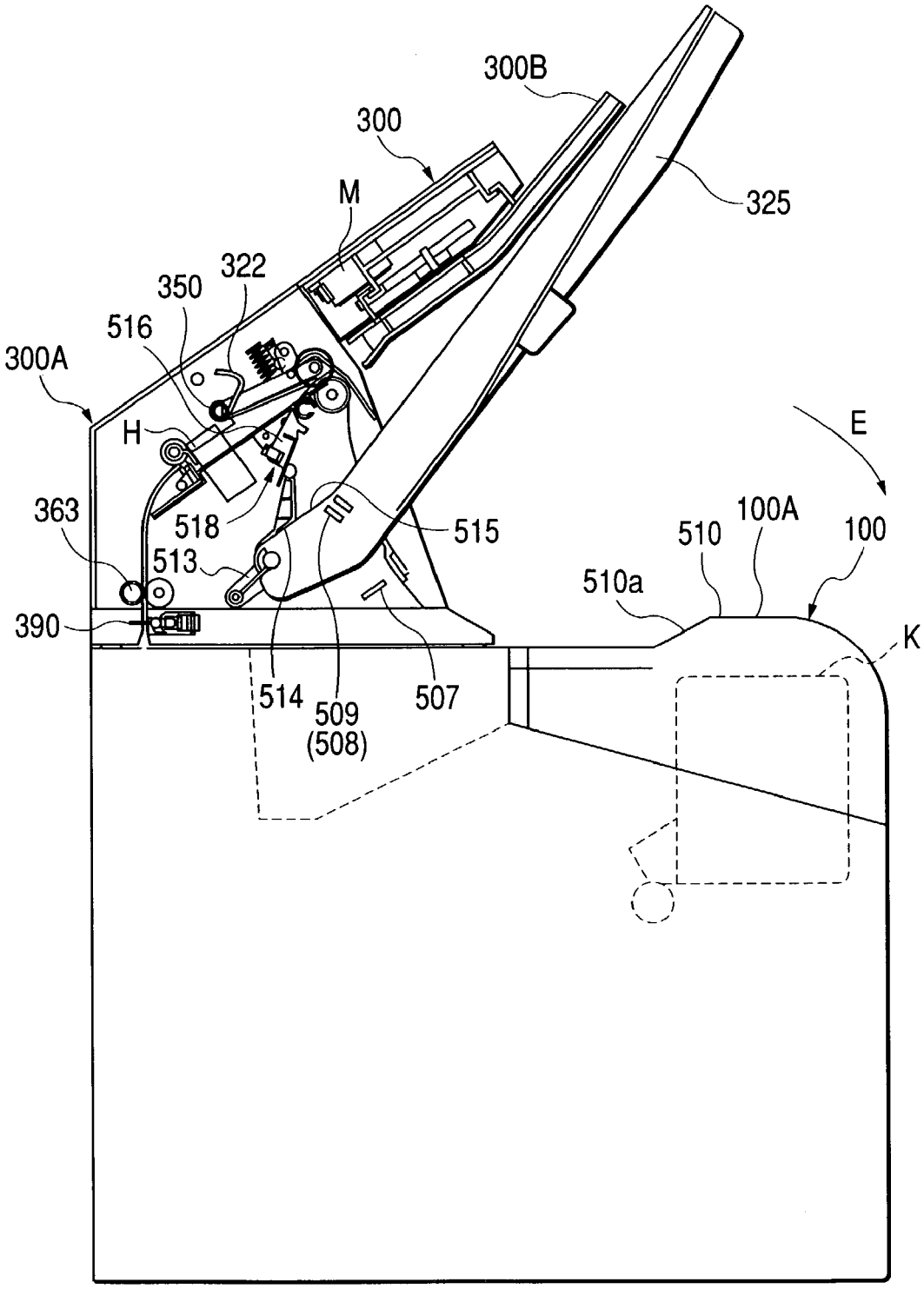
FIG. 14 is a cross-sectional view illustrating the operation of the discharged sheet stacking tray, and shows a state in which the discharged sheet stacking tray is raised to the second position and the cartridge cover is closed.

When the user depresses the cartridge cover 510 against the locking force of the lock mechanism of the cartridge cover 510, the lock of the locking mechanism is released and the cartridge cover 510, as shown in FIG. 14, is pivotally moved in the direction of arrow E and closes the apparatus main body 100A. At this time, the discharged sheet stacking tray 325 remains held in the second position by the engagement of the stopper member 509 with the holding member 508. Thereafter, the discharged sheet stacking tray 325 is received and held in the first position by the holding piece 507 by the user depressing the discharged sheet stacking tray 325 against the engagement force between the stopper member 509 and the holding member 508.

In the above-described mechanism, the holding piece 507, the holding member 508, the stopper member (engagement portion) 509, etc. together constitute a holding portion 511.

Description will now be made of the construction and operation of a jam detecting portion 512 for detecting the jam of a sheet occurring near the pair of sheet discharge rollers 330.

As shown in FIG. 10, the jam detecting portion 512 is comprised of a sheet discharge sensor flag 516, a photosensor 517, etc. The sheet discharge sensor flag 516 is adapted to be pivotally moved about a shaft, not shown, and detect the jam of the sheet near the pair of sheet discharge rollers 330. The photosensor 517 is adapted to detect the operation of the sheet discharge sensor flag 516.

The sheet discharge sensor flag 516 is pivotally moved in the direction of arrow F each time a sheet, not shown, passes a path 519, and shields the photosensor 517 from light. This sheet discharge sensor flag 516 is adapted to be pivotally moved only when the sheet discharge upper roller 330*a* and sheet discharge lower roller 330*b* of the pair of sheet discharge rollers 330 are not spaced apart from each other. When in a state in which the sheet discharge upper roller 330*a* and the sheet discharge lower roller 330*b* are in contact with each other, a sheet stagnates in the path 519 and the sheet discharge sensor flag 516 shields the photosensor 517 from light for a predetermined time or longer, the occurrence of jam is detected and the sheet post-treating apparatus 300 is stopped.

Description will now be made of the mechanism and operation of a position detecting portion 518 for detecting that the discharged sheet stacking tray 325 is in the second position.

The position detecting portion 518 is a mechanism utilizing the aforedescribed jam detecting portion 512, and a mechanism comprising the jam detecting portion 512 plus a tray detecting lever 513.

That is, the position detecting portion 518 is comprised of the sheet discharge sensor flag 516, the photosensor 517, the tray detecting lever 513, etc.

The tray detecting lever 513 is adapted to be pivotally moved about a fulcrum 504 by gravity. Also, the tray detecting lever 513 is adapted to be capable of being received in the portion of a supporting surface 514 by the rib surface 515 of the discharged sheet stacking tray 325.

When the discharged sheet stacking tray 325 is moved to the second position, the supporting surface 514 of the tray detecting lever 513 is pushed by the rib surface 515 of the discharged sheet stacking tray 325 and the tray detecting lever 513 is rotated in a counter-clockwise direction indicated in FIG. 12 from the state shown in FIG. 10.

Thereupon, the tip end portion 520 of the tray detecting lever 513 pushes the sheet discharge sensor flag 516 and pivotally moves the latter in a clockwise direction. The sheet discharge sensor flag 516 is pivotally moved and shields the photosensor 517 from light. As a result, there is brought about the same state as that when the jam detecting portion 512 has detected jam, and the photosensor 517 informs the user that there is not brought about a state in which a sheet flows, and stops the sheet post-treating apparatus 300. As a result, when the discharged sheet stacking tray 325 is in the second position, the sheet post-treating apparatus 300 is such that no sheet is discharged to the discharged sheet stacking tray 325, and as shown in FIGS. 13 and 14, the jam of a sheet can be obviated until the interchange of the cartridge K is terminated.

(Second Embodiment)

A sheet post-treating apparatus 370 according to a second embodiment of the present invention will hereinafter be described with reference to FIGS. 15 to 19. In this embodiment, the same portions as those of the sheet post-treating apparatus 300 according to the first embodiment are given the same reference characters and need not be described.

The sheet post-treating apparatus 370 according to the second embodiment is designed such that by the utilization of the construction of a full load detecting portion 530 for detecting that the discharged sheet stacking tray 325 is fully loaded with sheets, it is detected by a position detecting portion 529 that the discharged sheet stacking tray 325 is in the second position.

Figure 15:
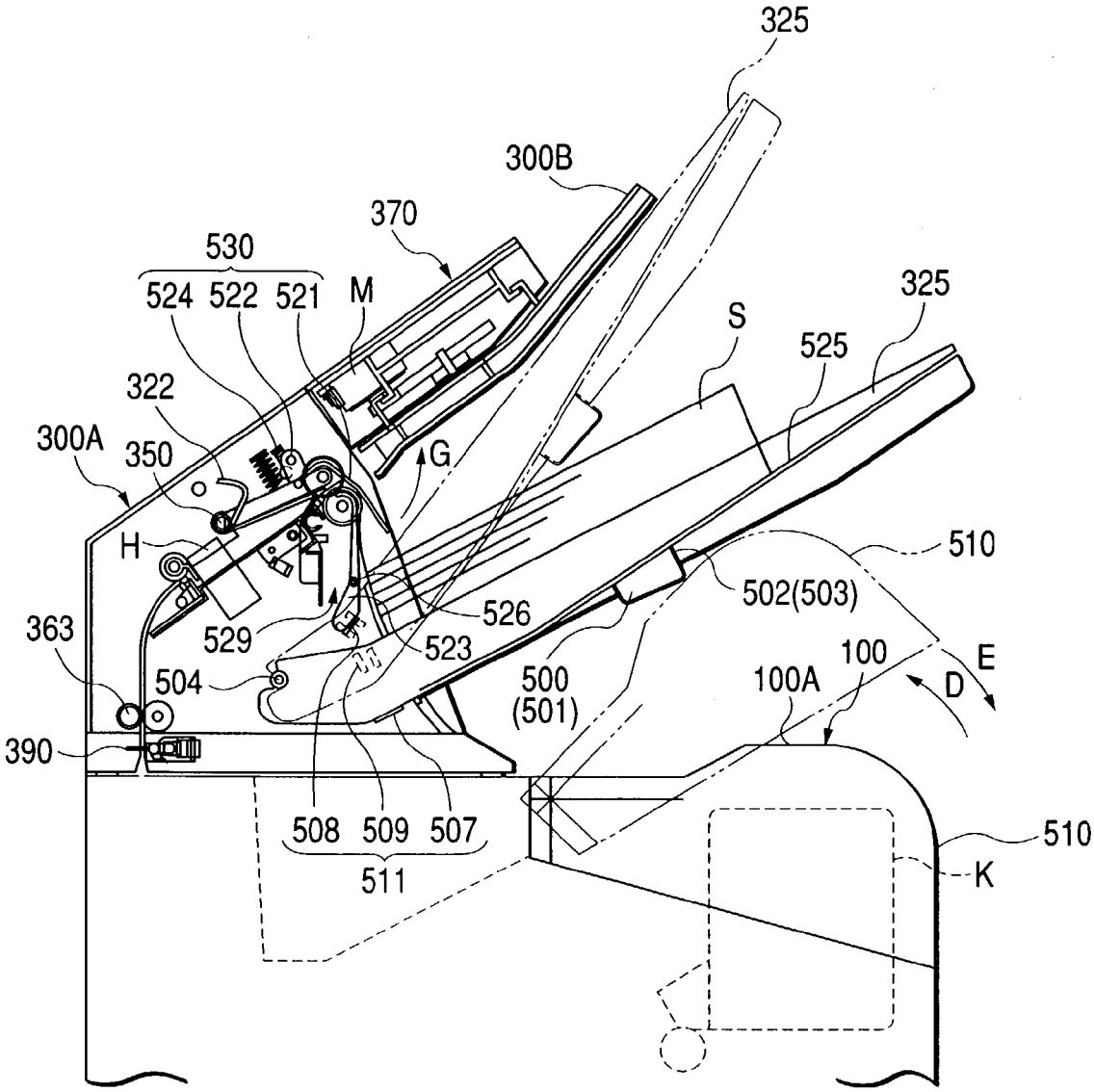
FIG. 15 is a cross-sectional view of a printer which is an image forming apparatus having mounted on its main body a sheet post-treating apparatus which is a discharged sheet stacking apparatus according to a second embodiment of the present invention.
Figure 16:
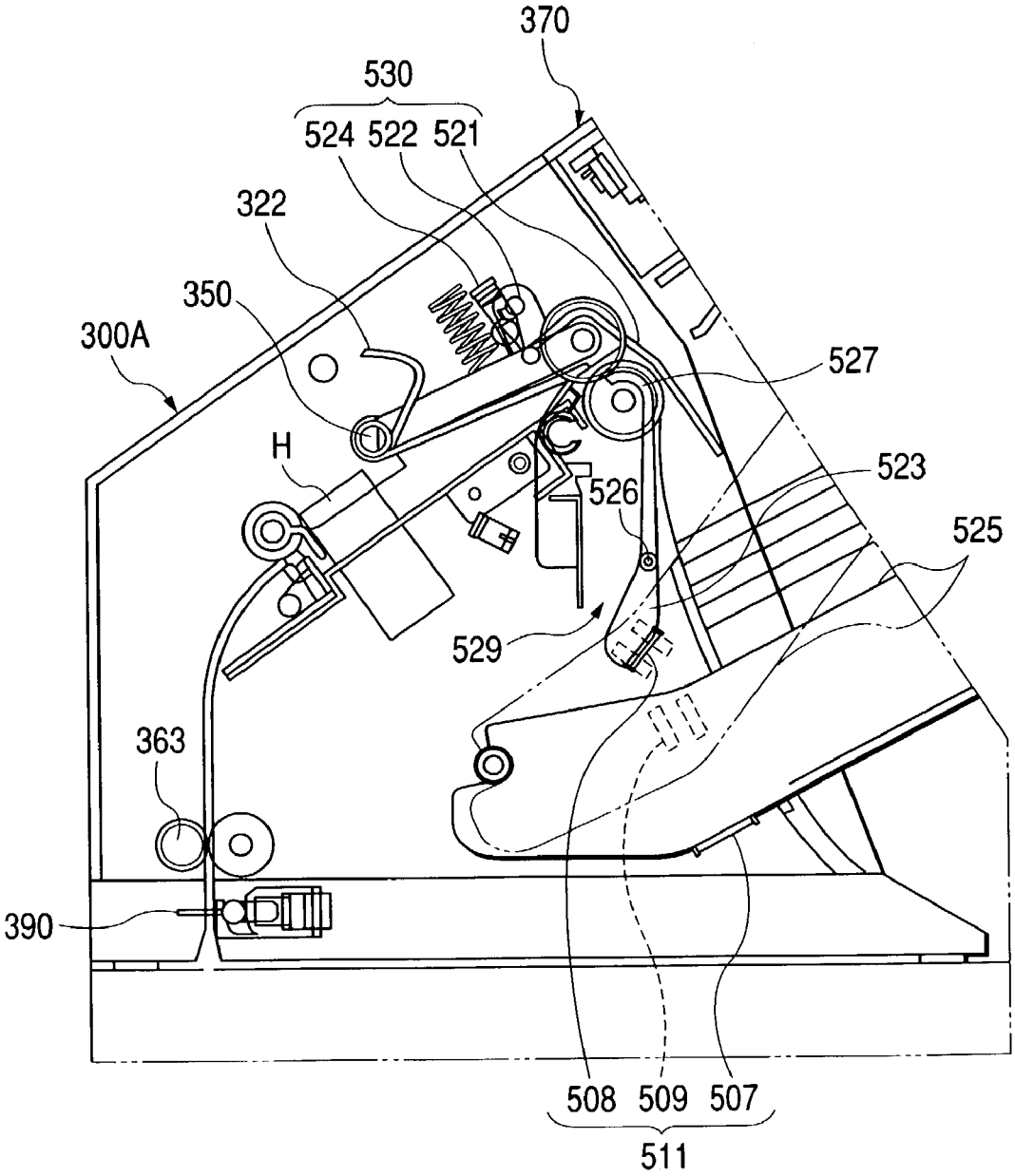
FIG. 16 is an enlarged view of the surroundings of the position detecting portion of FIG. 15.

As shown in FIG. 15, the full load detecting portion 530 is comprised of a full load detecting flag 521, a photosensor 524, etc. The full load detecting flag 521 is adapted to be pivotally moved about a fulcrum 522 along the sheet stacking surface 525 of the discharged sheet stacking tray 325 by gravity. This full load detecting flag 521 is adapted, when pivotally moved by a predetermined amount in conformity with the number of stacked sheets, to make the photosensor 524 transmit light therethrough.

The full load detecting portion 530, when the discharged sheet stacking tray 325 is fully loaded with sheets, is such that the full load detecting flag 521 makes the photosensor 524 transmit light therethrough and detects that the discharged sheet stacking tray 325 is fully loaded with sheets. Also, the full load detecting portion 530 informs the user that the discharged sheet stacking tray 325 is fully loaded with the sheets, and stops the sheet post-treating apparatus 310.

The position detecting portion 529 is a mechanism utilizing the aforedescribed full load detecting portion 530, and is a mechanism comprising the full load detecting portion 530 plus a tray detecting lever 523. That is, the position detecting portion 529 is comprised of the full load detecting flag 521, the photosensor 524, the tray detecting lever 523, etc.

Figure 17:
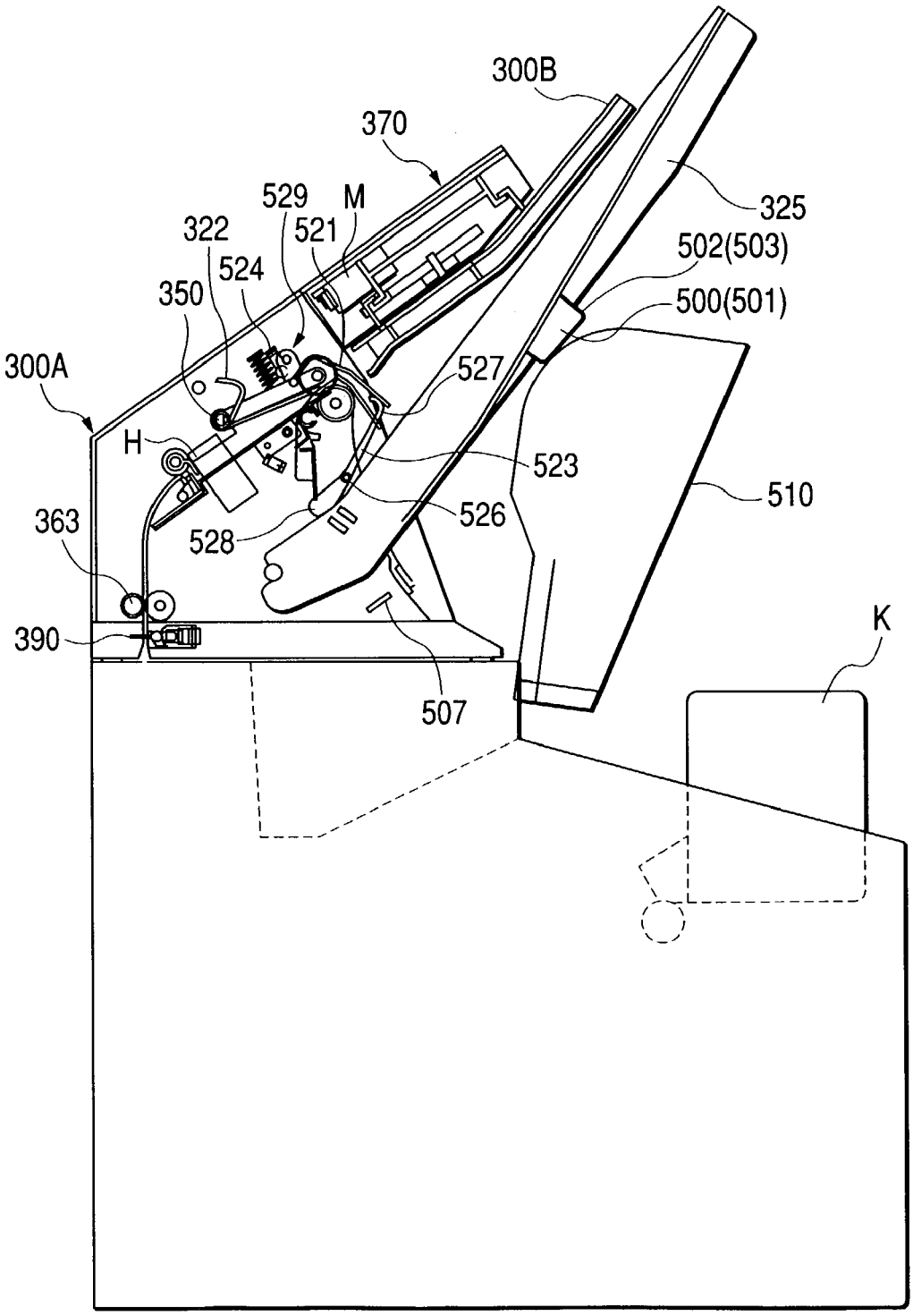
FIG. 17 is a cross-sectional view illustrating the operation of a discharged sheet stacking tray in the second embodiment, and shows a state when the discharged sheet stacking tray is raised to a second position.
Figure 18:
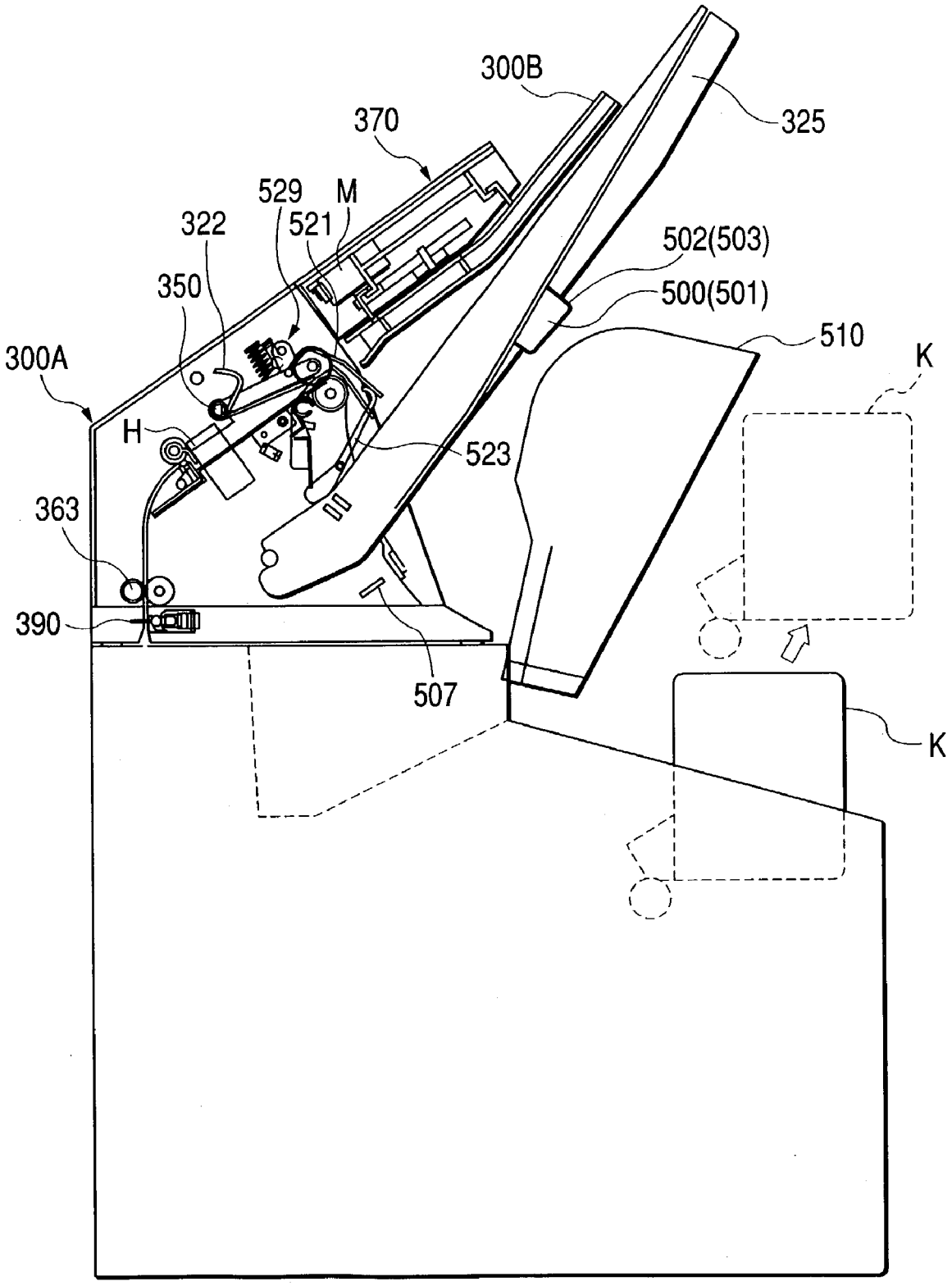
FIG. 18 is a cross-sectional view illustrating the operation of the discharged sheet stacking tray in the second embodiment, and shows a state in which the discharged sheet stacking tray is raised to the second position and a cartridge cover is stopped at a predetermined position.

The tray detecting lever 523 is adapted to be pivotally moved about a shaft 526, and in a state shown in FIG. 15, it is biased by a tension spring, not shown, so as to be rotated in a counter-clockwise direction as viewed in FIG. 15. This tray detecting lever 523 is rotated in a clockwise direction with its rear end portion 528 pushed by the discharged sheet stacking tray 325 as shown in FIG. 17 wherein the discharged sheet stacking tray 325 has been moved to the second position, and pushes the full load detecting flag 521 by a tip end portion 527 and pivotally moves it in a counter-clockwise direction.

As a result, the full load detecting flag 521 makes the photosensor 524 transmit light therethrough, and there is brought about the same state as that when the full load detecting portion 530 has detected that the discharged sheet stacking tray 325 has become fully loaded with sheets. Then, the full load detecting portion 530 (the position detecting portion 529) informs the user that the discharged sheet stacking tray 32 is not in a state in which it can discharge and stack sheets thereon.

Figure 19:
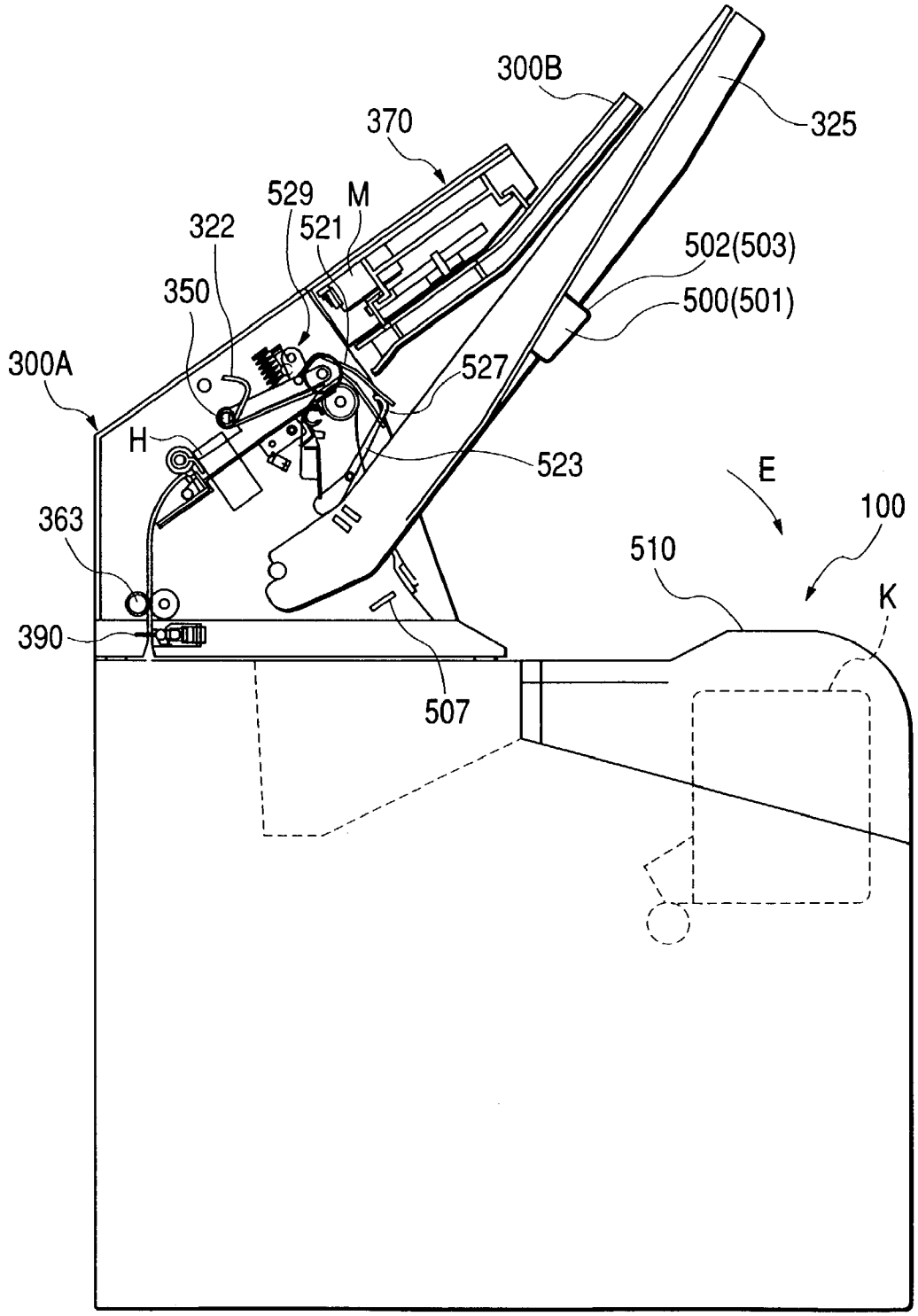
FIG. 19 is a cross-sectional view illustrating the operation of the discharged sheet stacking tray in the second embodiment, and shows a state in which the discharged sheet stacking tray is raised to the second position and the cartridge cover is closed.

Thus, it never happens that in a state as shown in FIG. 19 wherein the user has closed the cartridge cover 510 after he has interchanged the cartridge K, the sheet post-treating apparatus 370 is made to perform the operation of stacking sheets on the discharged sheet stacking tray 325.

Accordingly, the sheet post-treating apparatus 370 according to the second embodiment can also obviate the jam of a sheet.

Also, the sheet post-treating apparatus 370 according to the second embodiment, unlike the sheet post-treating apparatus 300 according to the first embodiment, is designed such that it is directly detected by the full load detecting portion 530 that sheets cannot be stacked on the discharged sheet stacking tray 325 and therefore, the user can confirm only the portions around the discharged sheet stacking tray 325, and need not confirm two things, i.e., the presence or absence of a jammed sheet and that the discharged sheet stacking tray 325 is in the second position, and handling becomes easy.

(Third Embodiment)

A sheet post-treating apparatus 380 according to a third embodiment of the present invention will hereinafter be described with reference to FIGS. 20, 21, 22A and 22B. In this embodiment, the same portions as those of the sheet post-treating apparatus 300 according to the first embodiment are given the same reference characters and need not be described. Also, the operation of the discharged sheet stacking tray 325 being pushed up by the cartridge cover 510 is substantially the same as the operations of the sheet post-treating apparatus 300 according to the first embodiment and the sheet post-treating apparatus 370 according to the second embodiment and therefore need not be described.

The sheet post-treating apparatus 380 according to the third embodiment is provided with a holding portion 566 for automatically releasing the discharged sheet stacking tray 325 held in the second position when the user closes the cartridge cover 510.

The holding portion 566 is comprised of a holding piece 507, a gear 561, the stopper member 509 of the discharged sheet stacking tray 326, etc. The fixing member or the fixing part of the laser beam printer 101 may be used in lieu of the holding piece 507.

The gear 561 is adapted to be driven and rotated in the direction of arrow J by a transport motor, not shown, for rotating the pair of sheet discharge rollers 330. A one-way clutch, not shown, is mounted between the gear 561 and the transport motor, not shown. Therefore, the gear 561 is not rotated when the transport motor, not shown, rotates the pair of sheet discharge rollers 330 in the direction of arrow N. The gear 561, however, is rotated in the direction of arrow J when the transport motor, not shown, rotates the pair of sheet discharge rollers 330 in a direction opposite to the direction of arrow N.

The gear 561 is provided with a stopper portion 565 engaged by the stopper member 509 projectedly provided on the discharged sheet stacking tray 325. When the stopper member 509 comes into engagement with the stopper portion 565, at least one of them need escape and therefore, at least one of them is adapted to be elastically deformed or the gear 561 itself is adapted to be elastically deformed. Further, the stopper portion 565 (see FIGS. 22A and 22B) and the stopper member 509 are formed with inclined surfaces 565*a* and 509*a*, respectively, so that the stopper member 509 may easily come in from below. At least one of these inclined surfaces 565*a* and 509*a* may be formed.

Figure 20:
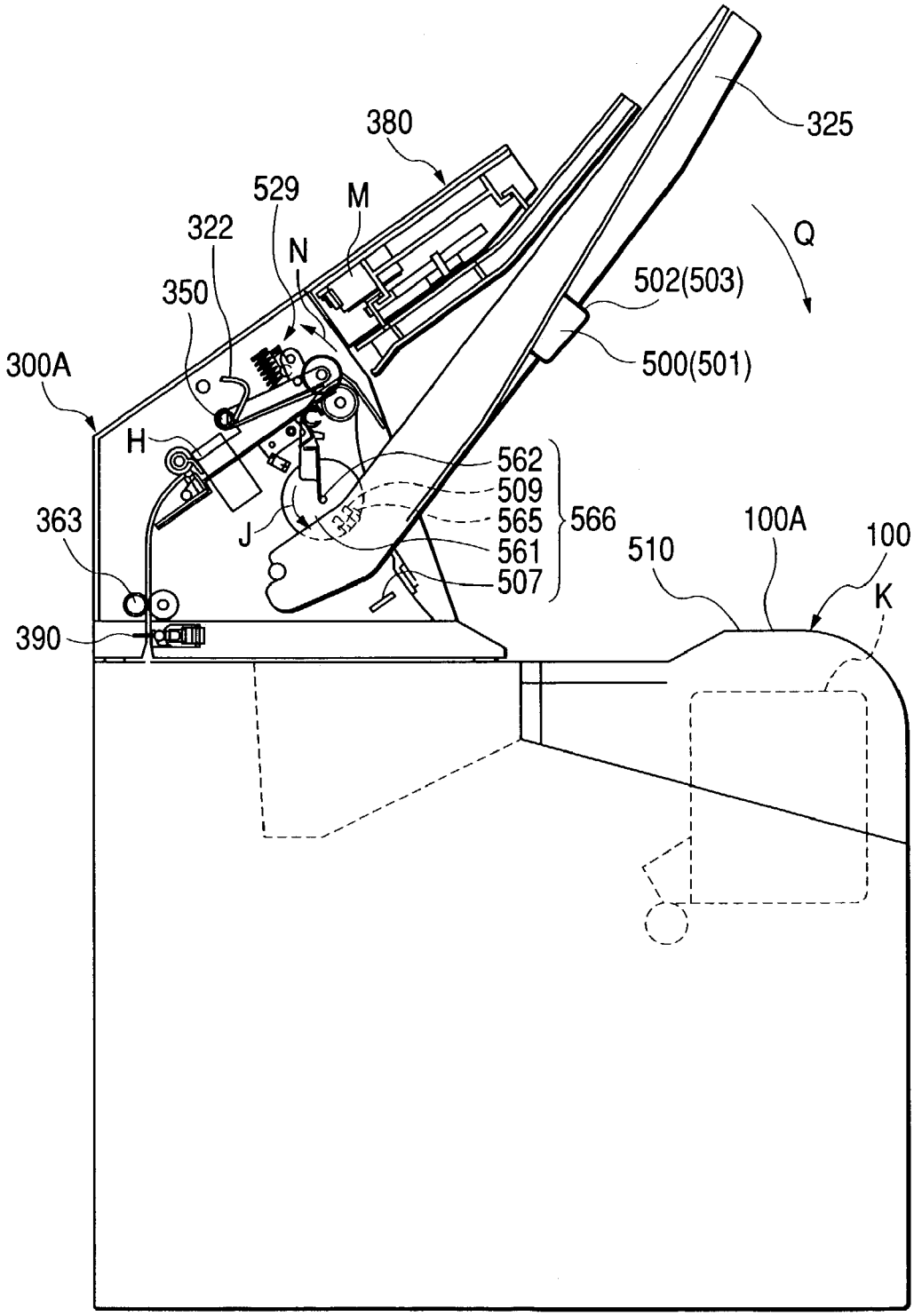
FIG. 20 is a cross-sectional view illustrating the operation of a discharged sheet stacking tray in an image forming apparatus having mounted on its main body a sheet post-treating apparatus which is a discharged sheet stacking apparatus according to a third embodiment of the present invention, and shows a state in which a discharged sheet stacking tray is raised to a second position and a cartridge cover is closed.

FIG. 20 shows a state in which after discharged sheet stacking tray 325 has been pushed up by the cartridge cover 510, the cartridge cover 510 is closed and the discharged sheet stacking tray 325 is held in the second position by the holding portion 566.

The discharged sheet stacking tray 325 is caught by the stopper portion 565 of the gear 561 and therefore is held in the position of FIG. 20. The home position of the gear 561 is always the position of FIG. 20 and is subjected to position control by a photosensor, not shown. The sheet post-treating apparatus 380 rotates the transport motor in a direction opposite to the direction of arrow N during the initial time to thereby rotate the gear 561 in the direction of arrow J. In order to make the stopper portion 565 automatically separate from the stopper member 509, design is made such that the discharged sheet stacking tray 325 falls in the direction of arrow Q by gravity and strikes against the holding piece 507 and is returned to the first position.

Figure 21:
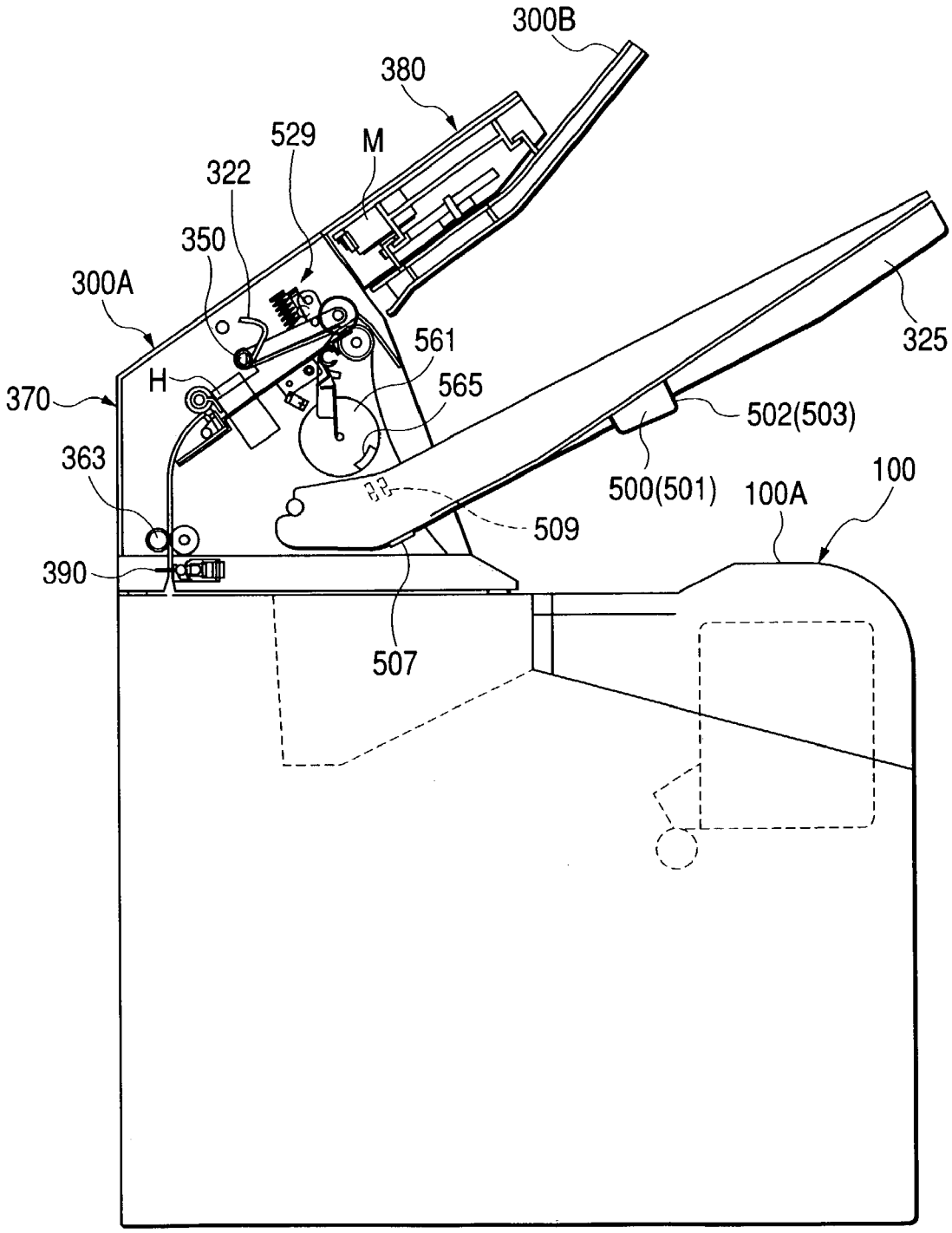
FIG. 21 is a cross-sectional view illustrating the operation of the discharged sheet stacking tray in the third embodiment, and shows a state in which the discharged sheet stacking tray is in a first position.
Figure 22B:
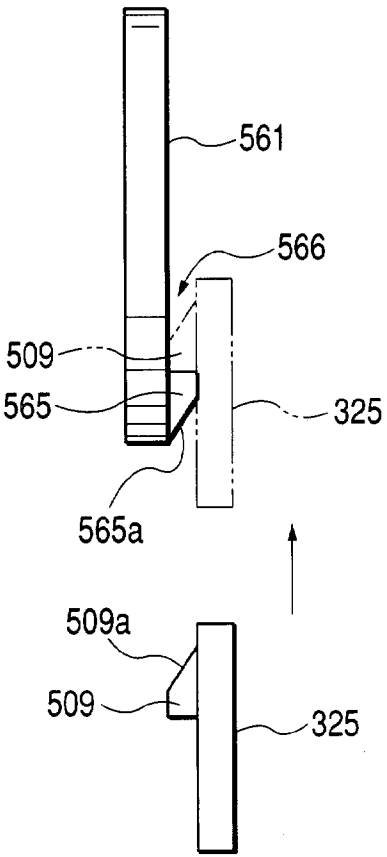
FIG. 22B is a side view of the holding portion.
Figure 22A:
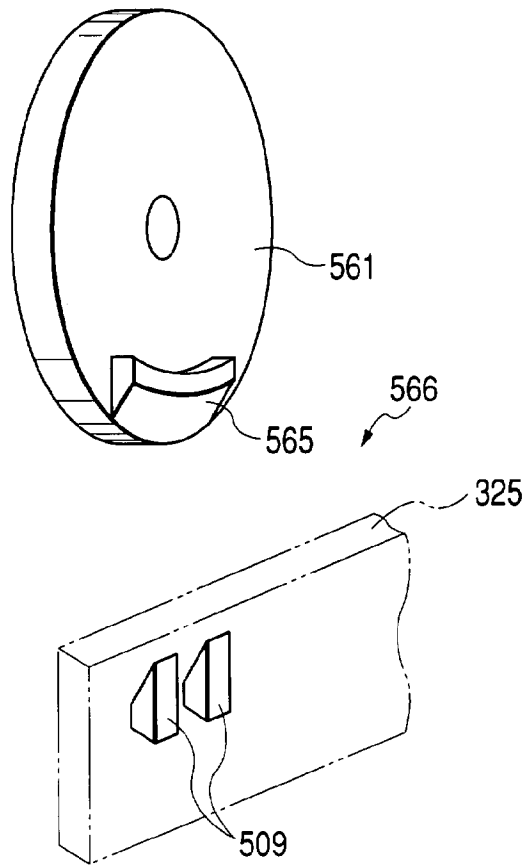
FIG. 22A is a perspective view of the holding portion of the sheet post-treating apparatus which is the discharged sheet stacking apparatus according to the third embodiment.

FIG. 21 shows the returned state of the discharged sheet stacking tray, and the gear 561 makes one full rotation and returns to its original position. Thus, whenever the discharged sheet stacking tray 325 is raised, the stopper portion 565 of the gear 561 is in a position in which it is engageable with the stopper member 509 of the discharged sheet stacking tray 325. Therefore, next, the discharged sheet stacking tray 325, when raised again, is held in the second position shown in FIG. 20.

When the cartridge cover 510 is closed and the printer 101 enters a ready state and receives a signal indicative of that, the initial operation of the sheet post-treating apparatus 380 is performed, whereby the transport motor is rotated and the gear 561 is rotated, and the discharged sheet stacking tray 325 can automatically return to the first position and thus, the operations by the user are decreased.

The sheet post-treating apparatus 380 according to the third embodiment is designed such that the discharged sheet stacking tray 325 can be held in the second position and therefore, the interchange of the cartridge K and maintenance can be done easily. Also, since design is made such that when the cartridge cover 510 is closed, the discharged sheet stacking tray 325 held in the second position can be automatically released, the jam of a sheet can be obviated. Also, the sheet post-treating apparatus 380 is excellent in operability.

As described above, the sheet post-treating apparatuses (sheet stacking apparatuses) 300, 370 and 380 are provided with the discharged sheet stacking tray 325 displaceably provided in the casing portion (apparatus main body) 300A and stacking thereon the sheets S discharged from the casing portion 300A, and the holding portion (holding means) 511, 566 for holding the discharged sheet stacking tray 325 in the first position and the second position overlying the first position, and are designed such that the sheets S are stacked when the discharged sheet stacking tray 325 is in the first position and therefore, when for example, the sheet post-treating apparatus is incorporated into the printer (image forming apparatus) 101 and the cartridge K in the printer 101 is to be interchanged with the cartridge cover 510 opened, the user can retract the discharged sheet stacking tray 325 to the second position to thereby interchange the cartridge K and therefore, it becomes unnecessary to detach the discharged sheet stacking tray 325, or to provide in advance the discharged sheet stacking apparatus above the main body 100A of the printer 101 by an amount corresponding to the space required for the cartridge cover 510 to be pivotally moved.

The sheet post-treating apparatuses (sheet stacking apparatuses) 300 and 370 are provided with position detecting portions (position detecting means) 518 and 529, respectively, for detecting that the discharged sheet stacking tray 325 is in the second position and therefore, when for example, the sheet stacking apparatus 300 has been incorporated into the apparatus main body 100A and the discharged sheet stacking tray 325 has been displaced to the second position and the cartridge K in the printer 101 has been interchanged, the user can become aware of having forgotten to return the discharged sheet stacking tray 325 to the first position. Also, it is detected that the discharged sheet stacking tray 325 is in the second position, whereby the discharge of the sheets is stopped and the jam of the stacked sheets can be obviated.

The sheet post-treating apparatus (sheet stacking apparatus) 300 uses the position detecting portion (position detecting means) 518 also as a jam detecting portion (jam detecting means) 512 for detecting the jam of the sheets stacked on the discharged sheet stacking tray 325 and therefore, can detect the occurrence of jam and can be simplified in its construction and be reduced in cost.

The sheet post-treating apparatus (sheet stacking apparatus) 380 is such that the holding position (holding means) 566 is provided with the gear (rotary member) 561 provided with the stopper portion (engaged portion) 565 for holding the discharged sheet stacking tray 325 in the second position, and the stopper member (engagement portion) 509 provided on the discharged sheet stacking tray 325, and the gear 561 is rotated, whereby the discharged sheet stacking tray 325 is released from the second position and therefore, if the gear 561 is designed to be rotated by a drive source such as a motor or a plunger, the discharged sheet stacking tray 325 can be simply released from the second position.

The printer (image forming apparatus) 101 is provided with the apparatus main body 100 openably and closably having the openable and closable portion (cartridge cover 510), the image forming portion (image forming means) 102 provided in the apparatus main body 100 for forming images on sheets, and the sheet post-treating apparatus (discharged sheet stacking apparatus) 300, 370, 380 on which the sheets having images formed thereon by the image forming portion 102 are stacked, and the discharged sheet stacking tray 325 is located above the cartridge cover (openable and closable portion) 510 and therefore, when the sheet stacking apparatus is incorporated into the printer (image forming apparatus) 101 and the cartridge K in the printer 101 is to be interchanged with the cartridge cover 510 opened, the user can retract the discharged sheet stacking tray 325 to the second position and can interchange the cartridge K and thus, it becomes unnecessary to detach the discharged sheet stacking tray 325 or to provide in advance the sheet post-treating apparatus above the main body 100A of the printer 101 by an amount corresponding to the space required for the cartridge cover to be pivotally moved.

As regards the printer (image forming apparatus) 101, the discharged sheet stacking tray 325 has the ribs (receiving portions) 500, 501 for receiving it at a position opposed to the cartridge cover (openable and closable portion) 510 and therefore, when the discharged sheet stacking tray 325 is pushed up by the cartridge cover 510, the cartridge cover 510 is prevented from being damaged, and it never happens that the appearances of the printer 101 are spoiled.

The printer (image forming apparatus) 101 has the ribs (receiving portions) 500, 501 detachably provided on the discharged sheet stacking tray 325 and therefore, it will suffice if only the ribs 500, 501 are interchanged in conformity with the shape of the cartridge cover 510, and it is unnecessary to effect the design of the entire discharged sheet stacking tray and thus, cost can be reduced.

In the printer (image forming apparatus) 101, the polymer sheets (low friction members) 502, 503 lower in coefficient of friction than the receiving portions are provided on the portions in which the ribs 500, 501 abut against the cartridge cover 510 and therefore, the ribs 500, 501 are excellent in wear resistance and can be used for a long period.

(Fourth Embodiment)

Figure 23:
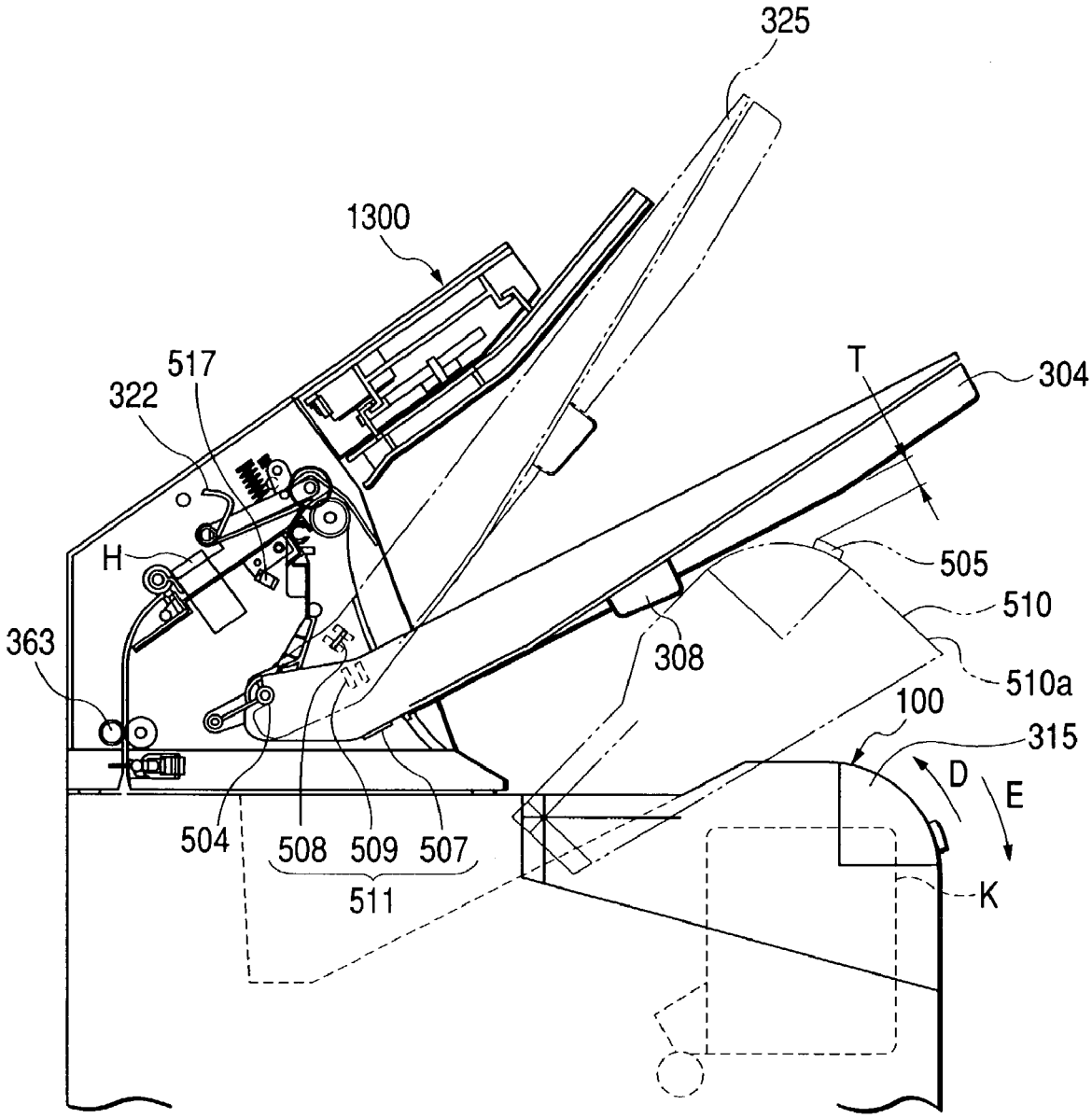
FIG. 23 is a cross-sectional view of the upper portion of a sheet post-treating apparatus which is a discharged sheet stacking apparatus according to a fourth embodiment of the present invention and an image forming apparatus main body.
Figure 24:
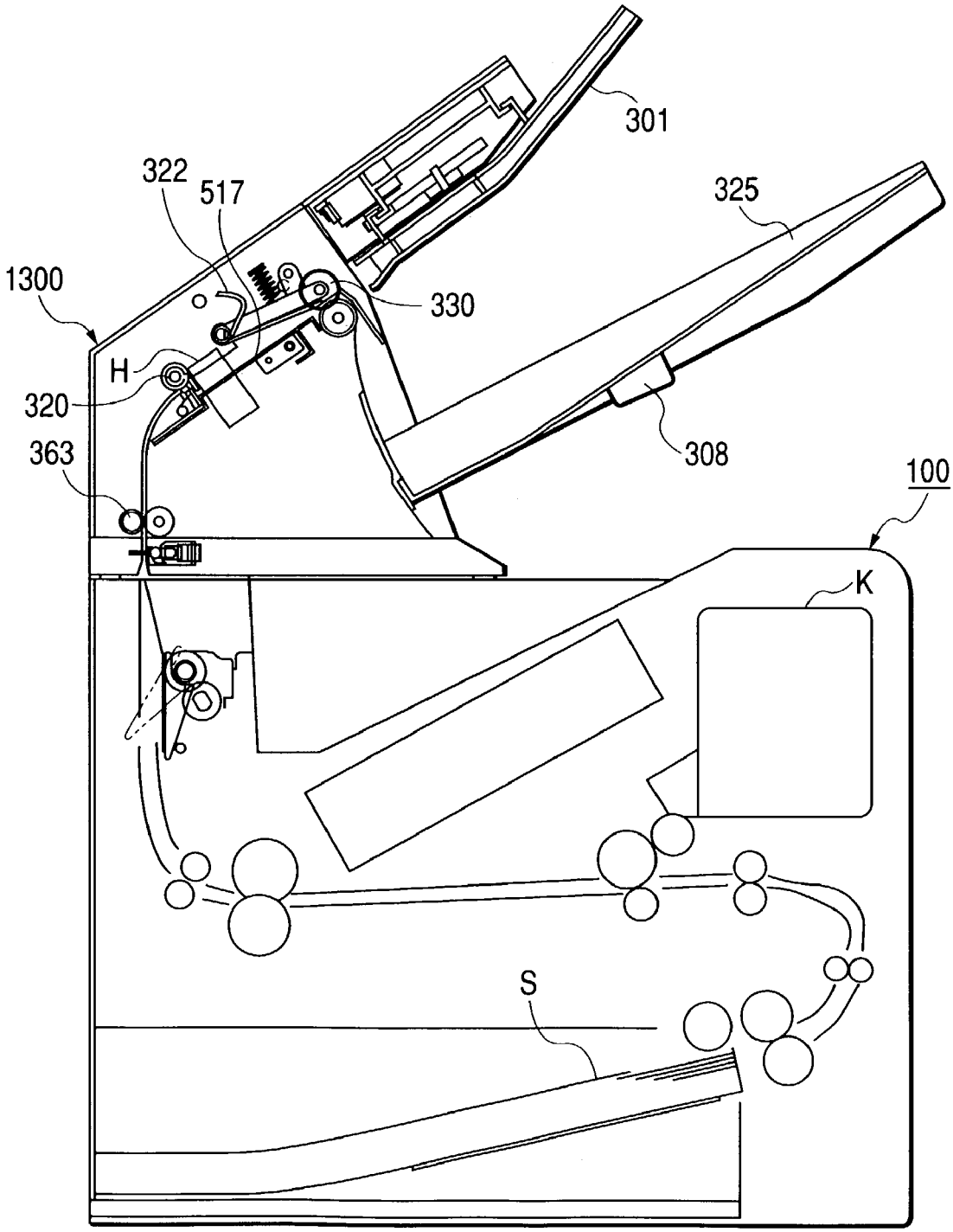
FIG. 24 shows the construction of an image forming apparatus.
Figure 25:
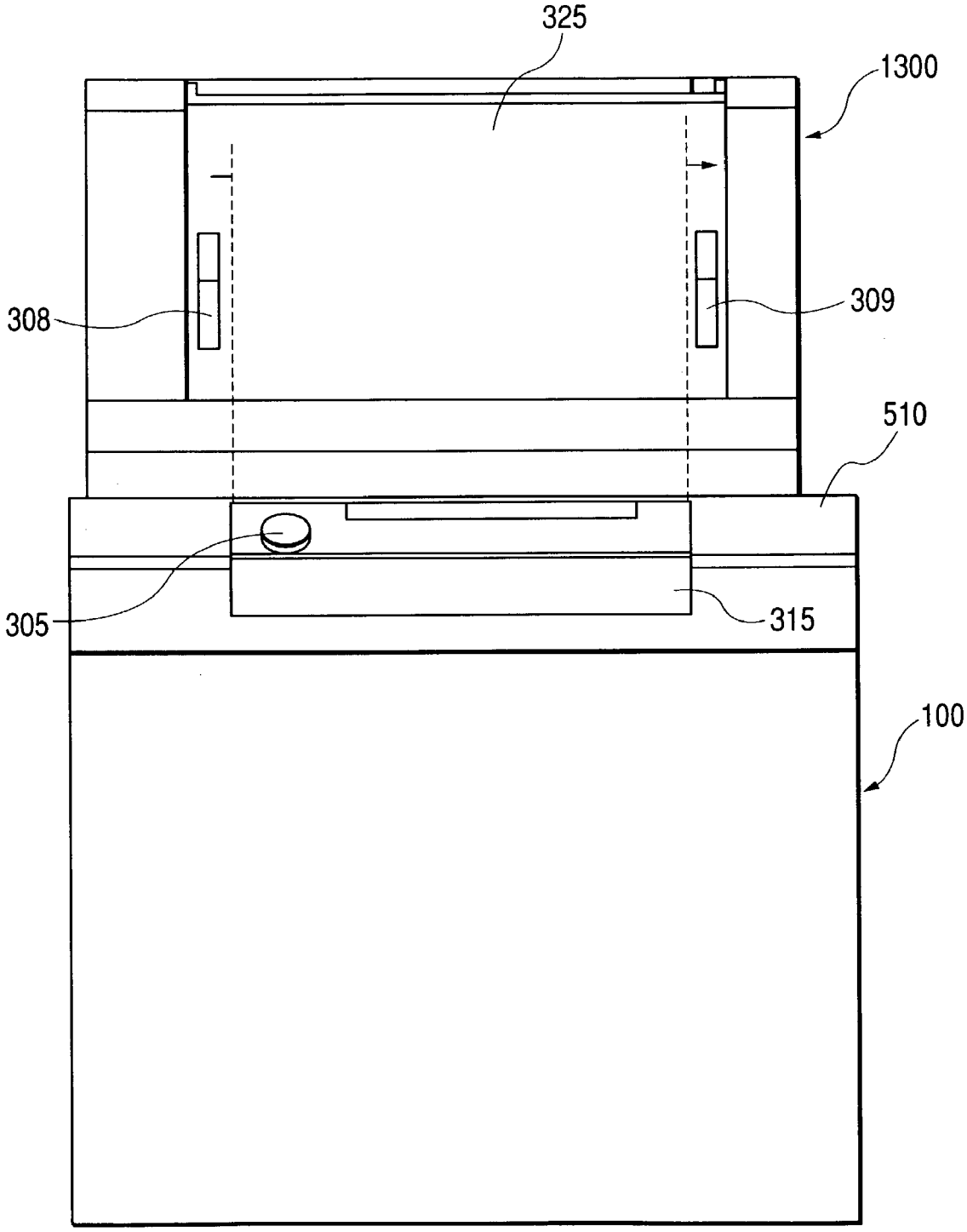
FIG. 25 is a front view of the image forming apparatus.
Figure 26:
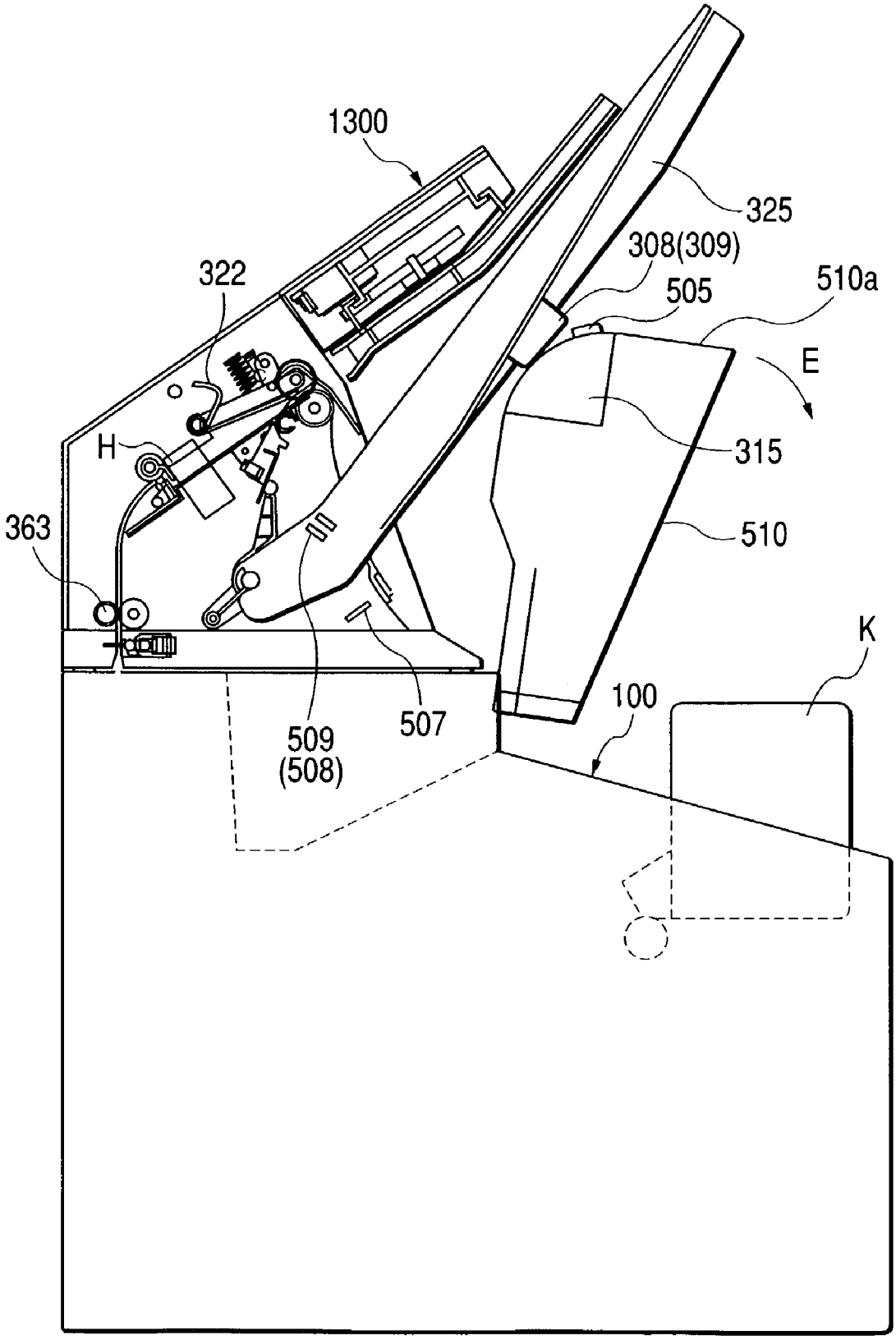
FIG. 26 is a cross-sectional view of the image forming apparatus in a state in which an openable and closable portion is opened and a discharged sheet stacking tray is raised to a second position.
Figure 27:
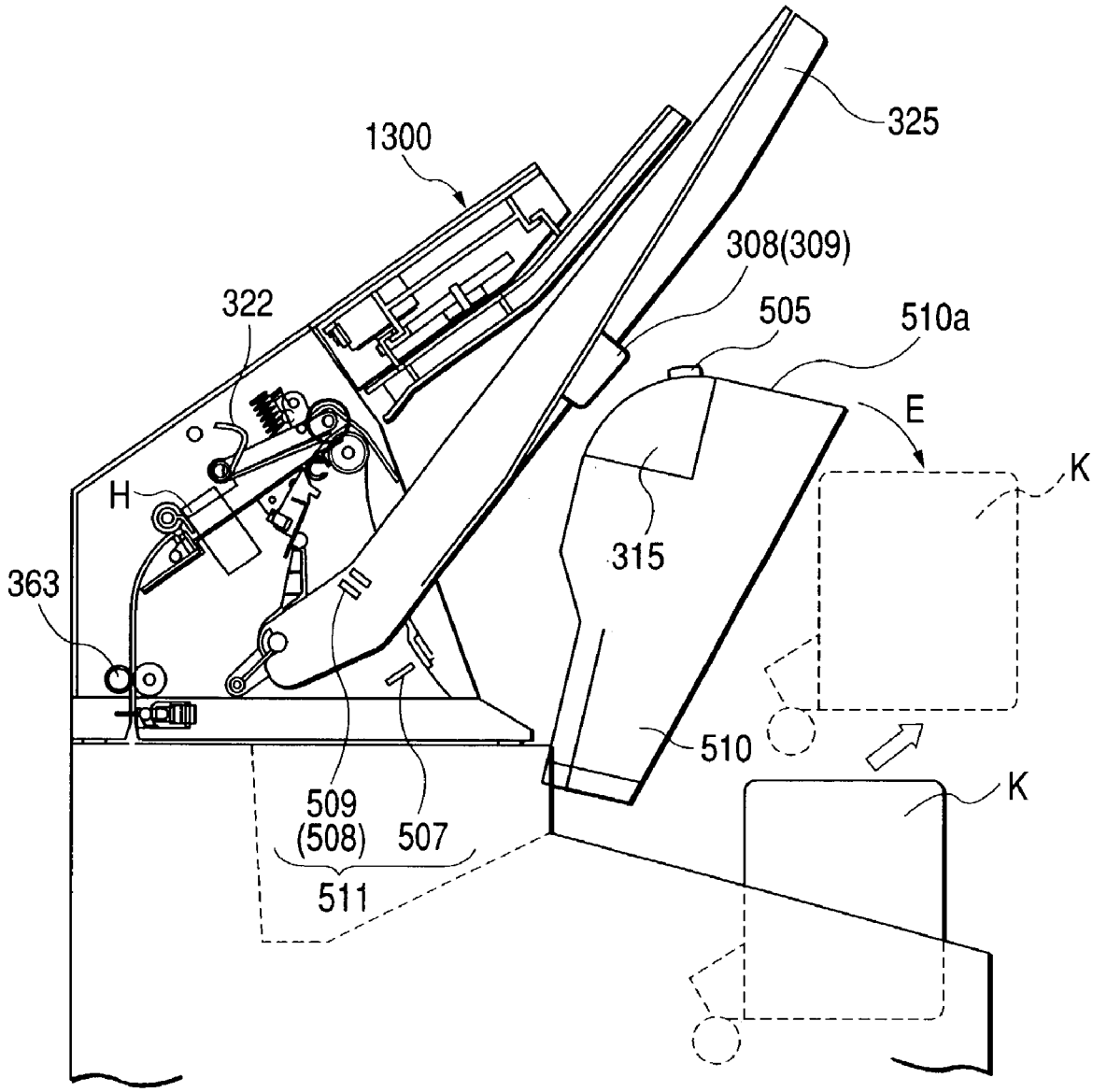
FIG. 27 is a cross-sectional view of the image forming apparatus in a state in which the discharged sheet stacking tray is raised to the second position and the openable and closable portion is stopped at a predetermined position.
Figure 28:
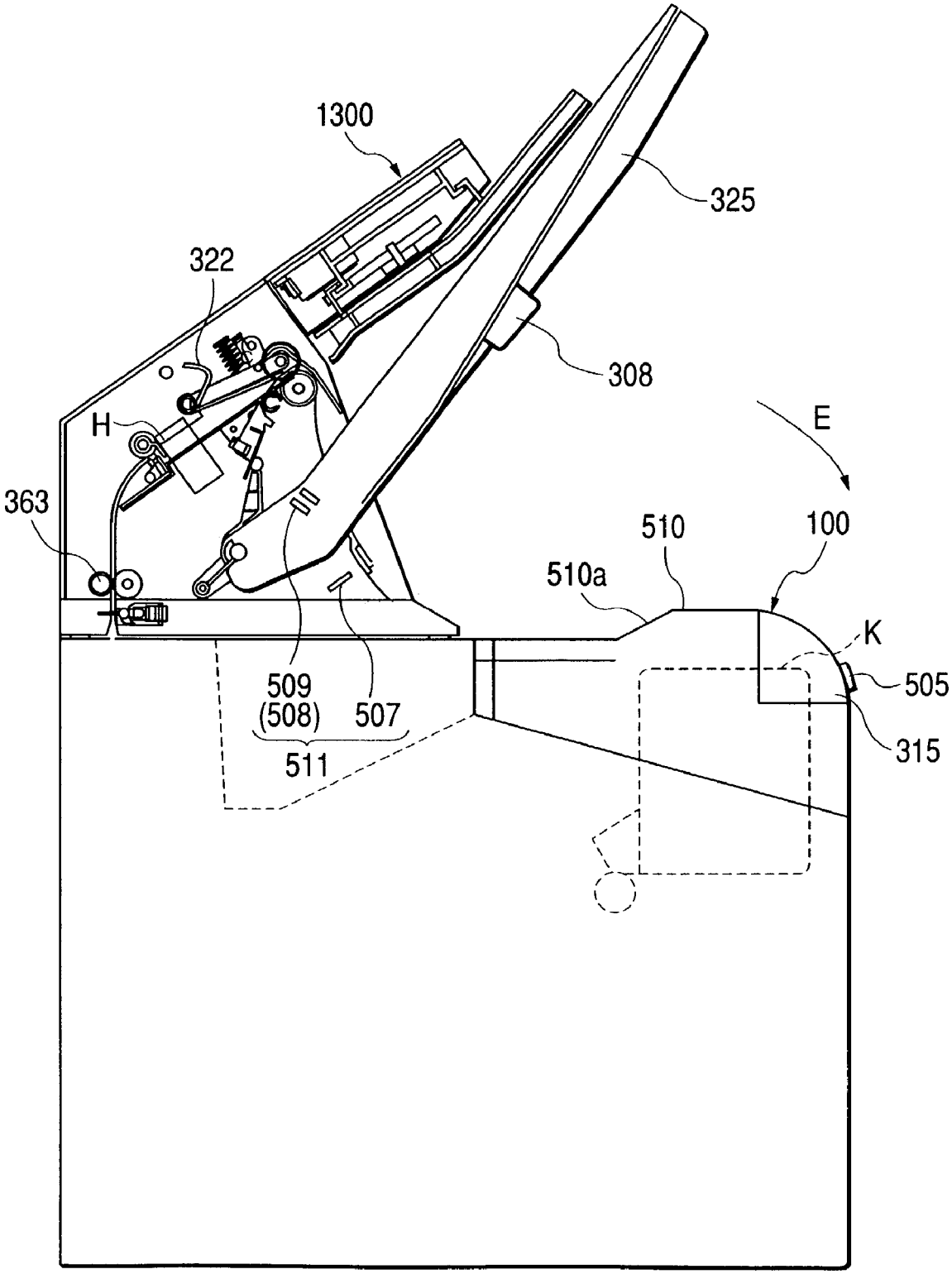
FIG. 28 is a cross-sectional view of the image forming apparatus in a state in which the discharged sheet stacking tray is raised to the second position and the openable and closable portion is closed.

A fourth embodiment of the sheet post-treating apparatus and the image forming apparatus according to the present invention will hereinafter be described with reference to the drawings. In this embodiment, the same portions as those of the sheet post-treating apparatus 300 according to the first embodiment are given the same reference characters and need not be described. FIG. 23 is a cross-sectional view of the upper portions of the sheet post-treating apparatus and the image forming apparatus main body according to the present embodiment, FIG. 24 shows the construction of the image forming apparatus, FIG. 25 is a front view of the image forming apparatus, FIG. 26 is a cross-sectional view of the image forming apparatus in a state in which the openable and closable portion is opened and the discharged sheet stacking tray is raised to the second position, FIG. 27 is a cross-sectional view of the image forming apparatus in a state in which the discharged sheet stacking tray is raised to the second position and the openable and closable portion is stopped at a predetermined position, and FIG. 28 is a cross-sectional view of the image forming apparatus in a state in which the discharged sheet stacking tray is raised to the second position and the openable and closable portion is closed.

The mechanism of the discharged sheet stacking tray 325 will now be described with reference to FIGS. 23 and 25 to 28. As shown in FIG. 23, the discharged sheet stacking tray 325 has a right rib 308 and a left rib 309 (see FIG. 25) of the same shape detachably provided on the underside near the ribs on the sides of the opposite ends in the widthwise direction of the sheet. Also, the right rib 308 and the left rib 309 are disposed at locations axially avoiding a printer operating portion 315.

The discharged sheet stacking tray 325 is adapted to be pivotally moved about a fulcrum 504 within the range of a first position (indicated by solid line in FIG. 23) for stacking the sheets S thereon and a second position (indicated by broken line in FIG. 23) for not stacking the sheets S thereon.

A holding piece 507, a holding member 508 and a stopper member 509 together constituting a holding portion 511 are disposed at locations on the widthwisely opposite sides of the discharged sheet stacking tray 325. The holding piece 507 and the holding member 508 are provided on the casing portion of the sheet post-treating apparatus 1300, and the stopper member 509 is provided on the discharged sheet stacking tray 325.

The holding piece 507 is a member for receiving and holding the discharged sheet stacking tray 325 in the first position. As the holding piece 507, use may be made of the fixing part of the image forming apparatus main body 100. The holding member 508 is a member engaged with the stopper member 509 to thereby hold the discharged sheet stacking tray 325 in the second position.

The holding member 508 is adapted to be engaged with the stopper member 509 and therefore, at least one of these two members has elasticity and is adapted to be engaged with and disengaged from the other by elastic deformation or to frequent relative to a mounted portion, and is adapted to be engaged with and disengaged from the other by the discharged sheet stacking tray 325 being pivotally moved against the frequenting force thereof.

Description will now be made of the handling of the sheet post-treating apparatus 1300 during the user's jam treatment, the maintenance of the image forming apparatus main body 100 and the interchange of the cartridge.

A cartridge cover 510, which is an openable and closable portion, is formed on the upper portion of the image forming apparatus main body 100. The cartridge cover 510 is a cover to be opened and closed when the user effects jam treatment and the interchange of the cartridge K. The cartridge cover 510, when it is rotated in the direction of arrow D and clears a predetermined angle, is locked by a lock mechanism (not shown) and is held in a state in which the image forming apparatus main body 100 is opened as shown in FIG. 23, and is adapted not to be lowered in the direction of arrow E from the lock point by gravity. Accordingly, the cartridge cover 510 is adapted not to hinder such work as the user's jam treatment, maintenance and the interchange of the cartridge with the image forming apparatus main body 100 opened.

The cartridge cover 510 is provided with an operating portion 315 for operating the image forming apparatus main body 100, and during the interchange of the cartridge, the operating portion 315 is pivotally moved with the cartridge cover 510. The operating portion 315 is comprised of an operating button 505 protruding from the outer peripheral surface 510*a* of the cartridge cover, a liquid crystal panel or the like.

The operation of opening the cartridge cover 510 will be described here.

When the user opens the cartridge cover 510 by a predetermined angle, the outer peripheral surface 510*a* of the cartridge cover 510 comes into contact with the right rib 308 and left rib 309 of the overlying discharged sheet stacking tray 325, as indicated by broken line in FIG. 23. The cartridge cover 510 is adapted not to contact with the other portions of the discharged sheet stacking tray 325 than the right rib 308 and the left rib 309. Also, at this time, the operating button 505 and the discharged sheet stacking tray 325 keep a predetermined gap T therebetween by the right rib 308 and the left rib 309.

When the cartridge cover 510 is further opened in the direction of arrow D, the right rib 308 and the left rib 309 begin to slide on the outer peripheral surface 510*a* of the cartridge cover 510. The discharged sheet stacking tray 325 is pushed by the cartridge cover 510 and starts to be pivotally moved from the first position indicated by solid line to the second position indicated by broken line. The cartridge cover 510 can be further pivotally moved from a predetermined lock point. At this time, the cartridge cover 510 is pivotally moved while keeping a gap T between the discharged sheet stacking tray 325 and the operating button 505. Also, at this time, the positional relationship among the right rib 308, the left rib 309 and the operating portion 315 in the widthwise direction of the sheet is such as shown in FIG. 25 wherein the right rib 308 and the left rib 309 are disposed at locations avoiding the operating portion 315 (the outside of the operating portion 315 in the widthwise direction of the sheet), and it never happens that the right rib 308 and the left rib 309 slide and move on the operating portion 315.

When the cartridge cover 510 is further pivotally moved, as shown in FIG. 26, the stopper member 509 provided on the discharged sheet stacking tray 325 once clears the holding member 508 and comes into engagement with the holding member 508, whereby the discharged sheet stacking tray 325 is held in the second position. At this time, the discharged sheet stacking tray 325 is held in the second position by the engagement between the stopper member 509 and the holding member 508 so as not to be lowered to the first position by gravity.

The cartridge cover 510, when released by the user, is downwardly pivotally moved to a predetermined angle by gravity, and is locked by a lock mechanism, not shown, and is held in a state in which the image forming apparatus main body 100 is opened, as shown in FIG. 27. At this time, the cartridge cover 510 is adapted to separate from the right rib 308 and left rib 309 of the discharged sheet stacking tray 325 so that the load of the discharged sheet stacking tray 325 may not be applied to the cartridge cover 510. As described above, in a state in which the cartridge cover 510 is locked and the image forming apparatus main body 100 is opened, the user effects such work as the jam treatment of the sheet, the maintenance of the image forming apparatus main body 100 and the interchange of the cartridge K.

The discharged sheet stacking tray 325 may be upwardly pivotally moved singly and earlier than the cartridge cover 510 and be held in the second position.

The operation of closing the cartridge cover 510 will now be described.

When the user depresses the cartridge cover 510 against the locking force of the lock mechanism of the cartridge cover 510, the lock by the lock mechanism is released and the cartridge cover 510, as shown in FIG. 28, is pivotally moved in the direction of arrow E to thereby close the image forming apparatus main body 100. At this time, the discharged sheet stacking tray 325 remains held in the second position by the engagement between the stopper member 509 and the holding member 508. By the user depressing the discharged sheet stacking tray 325 against the engagement force between the stopper member 509 and the holding member 508, the discharged sheet stacking tray 325 is received and held in the first position by the holding piece 507.

With the construction as described above, in a case where the discharged sheet stacking tray 325 of the sheet post-treating apparatus 1300 is above the cartridge cover 510, even when during the opening and closing of the cartridge cover 510 having the operating portion 315, the cartridge cover 510 abuts against the discharged sheet stacking tray 325, the operating button 505 is not depressed, and any wrong operation during the opening and closing of the cartridge cover 510 can be prevented. Also, the liquid crystal panel or the like of the operating portion 315 does not collide against the discharged sheet stacking tray 325, and the protection of such a part that is easily damaged, such as the liquid crystal panel or the like, can also be effected. Also, it is unnecessary to provide the operating portion 315 with a countermeasure for the prevention of the malfunctioning and damage of the operating portion 315 and therefore, it becomes possible to freely design the operating portion 315, and high designability can be obtained.

(Fifth embodiment)

Figure 29:
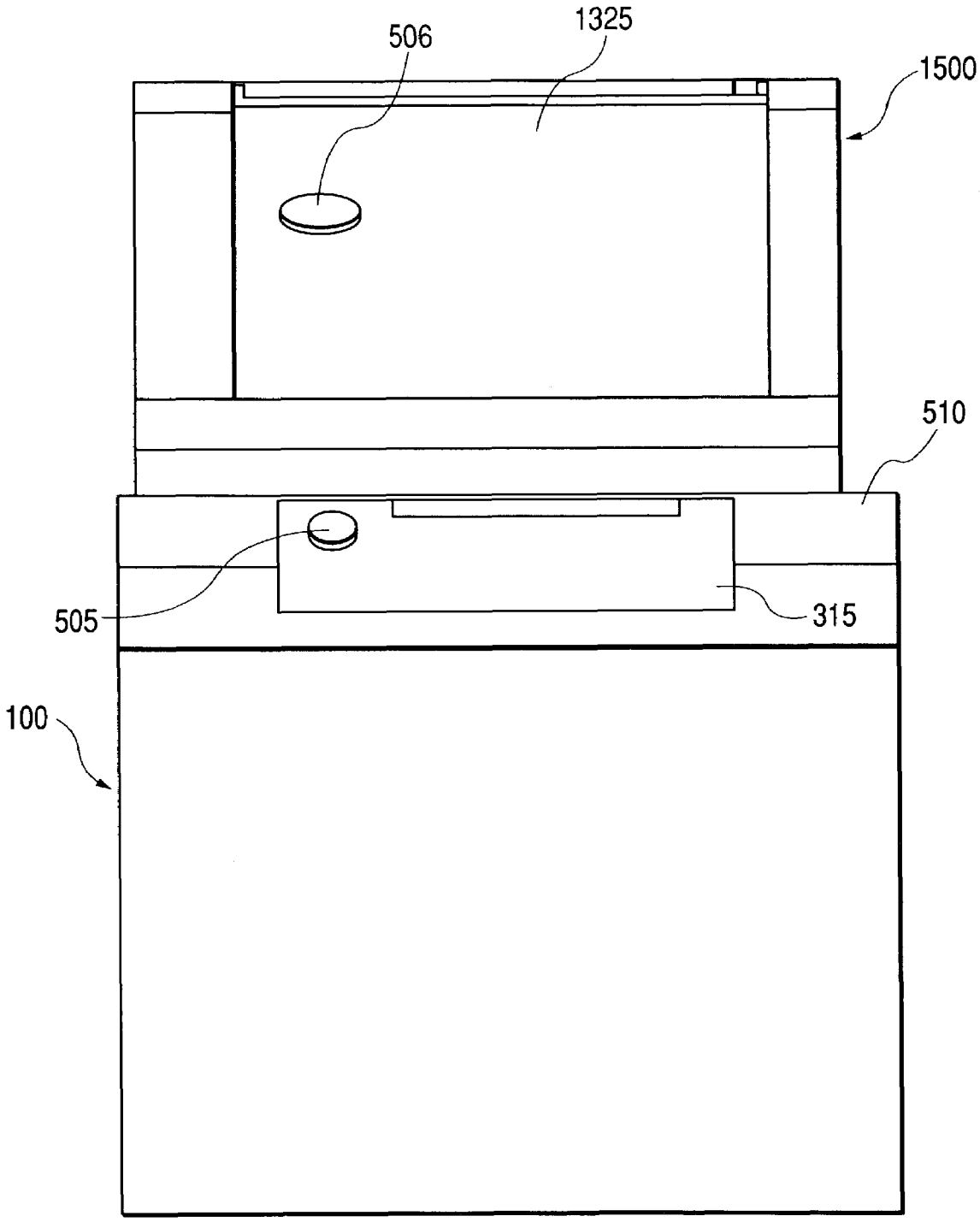
FIG. 29 is a front view of an image forming apparatus according to a fifth embodiment of the present invention.
Figure 30:
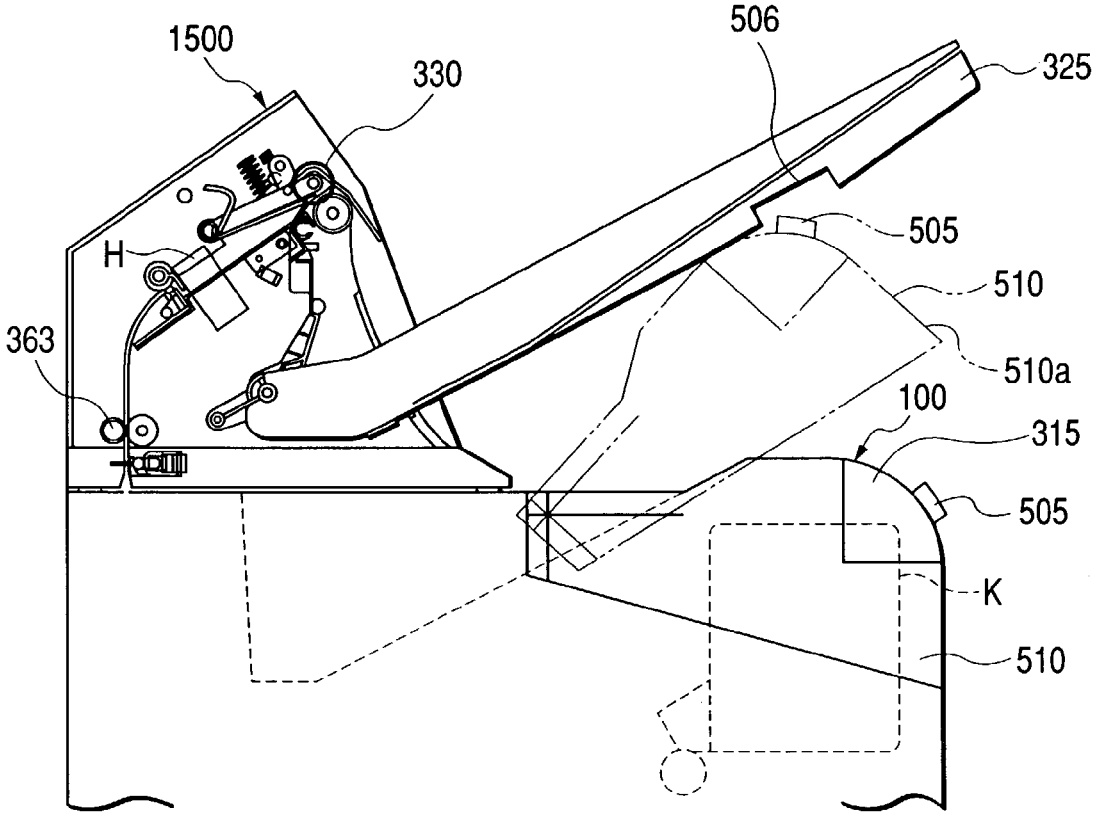
FIG. 30 is a cross-sectional view of the upper portions of a sheet post-treating apparatus which is a discharged sheet stacking apparatus in a state in which an openable and closable portion abuts against a discharged sheet stacking tray and an image forming apparatus main body.

A fifth embodiment of the sheet post-treating apparatus and the image forming apparatus according to the present invention will now be described with reference to the drawings. FIG. 29 is a front view of the image forming apparatus according to the present embodiment, and FIG. 30 is a cross-sectional view of the upper portions of the sheet post-treating apparatus and the image forming apparatus main body in a state in which an openable and closable portion abuts against a sheet stacking tray. In this embodiment, portions overlapping those in the description of the fourth embodiment are given the same reference characters and need not be described.

In the image forming apparatus C according to the present embodiment, a tray concave portion 506 is provided in lieu of the right rib 308 and left rib 309 of the discharged sheet stacking tray 325 of the sheet post-treating apparatus 1300 according to the fourth embodiment.

The image forming apparatus C is comprised of an image forming apparatus main body 100 and a sheet post-treating apparatus 1500.

The image forming apparatus main body 100 has a cartridge cover 510 provided in the upper portion of the image forming apparatus main body 100. The cartridge cover 510 has an operating portion 315, and an operating button 505 protruding from the outer peripheral surface 510*a* of the cartridge cover 510 is provided on the operating portion 315.

The sheet post-treating apparatus 1500 receives sheets discharged out of the image forming apparatus main body 100, and stacks them on a sheet stacking tray 1325 by entrance rollers 363 and discharge rollers 330. The tray concave portion 506 deeper than the height of the operating button 505 is provided in the underside of the sheet stacking tray 1325 at a location against which the operating portion 315 and the operating button 505 abut when the cartridge cover 510 is pivotally moved. Therefore, when the cartridge cover 510 is opened and closed and comes into contact with the discharged sheet stacking tray 1325, the operating portion 315 and the operating button 505 come into the tray concave portion 506, as shown in FIG. 30, and do not abut against the discharged sheet stacking tray 1325.

By such a construction, as in the above-described fourth embodiment, it never happens that the operating button 505 is depressed by mistake during the opening and closing of the cartridge cover 510, and the malfunctioning during the opening and closing of the cartridge cover 510 can be prevented. Also, it never happens that the liquid crystal panel or the like of the operating portion 315 collides against the discharged sheet stacking tray 1325, and the protection of such a part that is easily damaged, such as the liquid crystal panels can also be effected.

Also, in the sheet post-treating apparatus 1500 according to the present embodiment, unlike the sheet post-treating apparatus 1300 according to the fourth embodiment, the prevention of malfunctioning is done by the tray concave portion 506 provided in the underside of the discharged sheet stacking tray 1325 and therefore, it is unnecessary to provide members protruding from the discharged sheet stacking tray 1325 like the right rib 308 and the left rib 309, and the appearances of the sheet post-treating apparatus are not spoiled.

(Sixth Embodiment)

Figure 31:
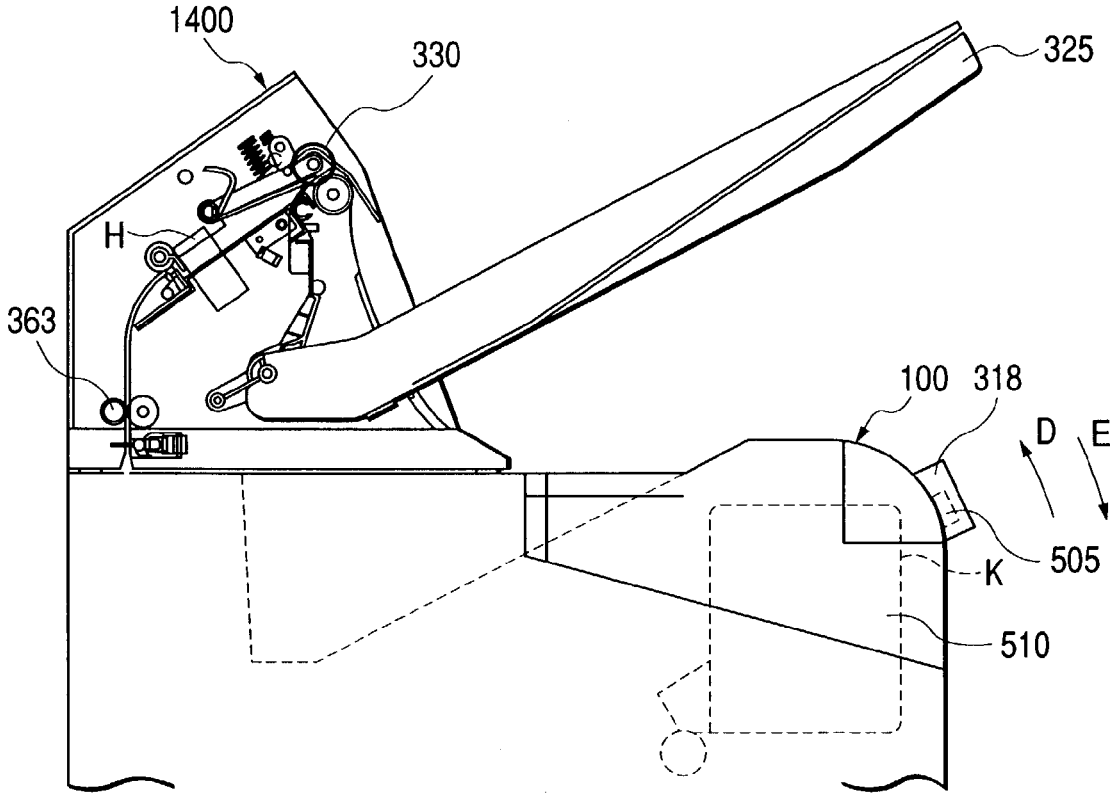
FIG. 31 is a cross-sectional view of the upper portions of a sheet post-treating apparatus which is a discharged sheet stacking apparatus according to a sixth embodiment of the present invention and an image forming apparatus main body.
Figure 32:
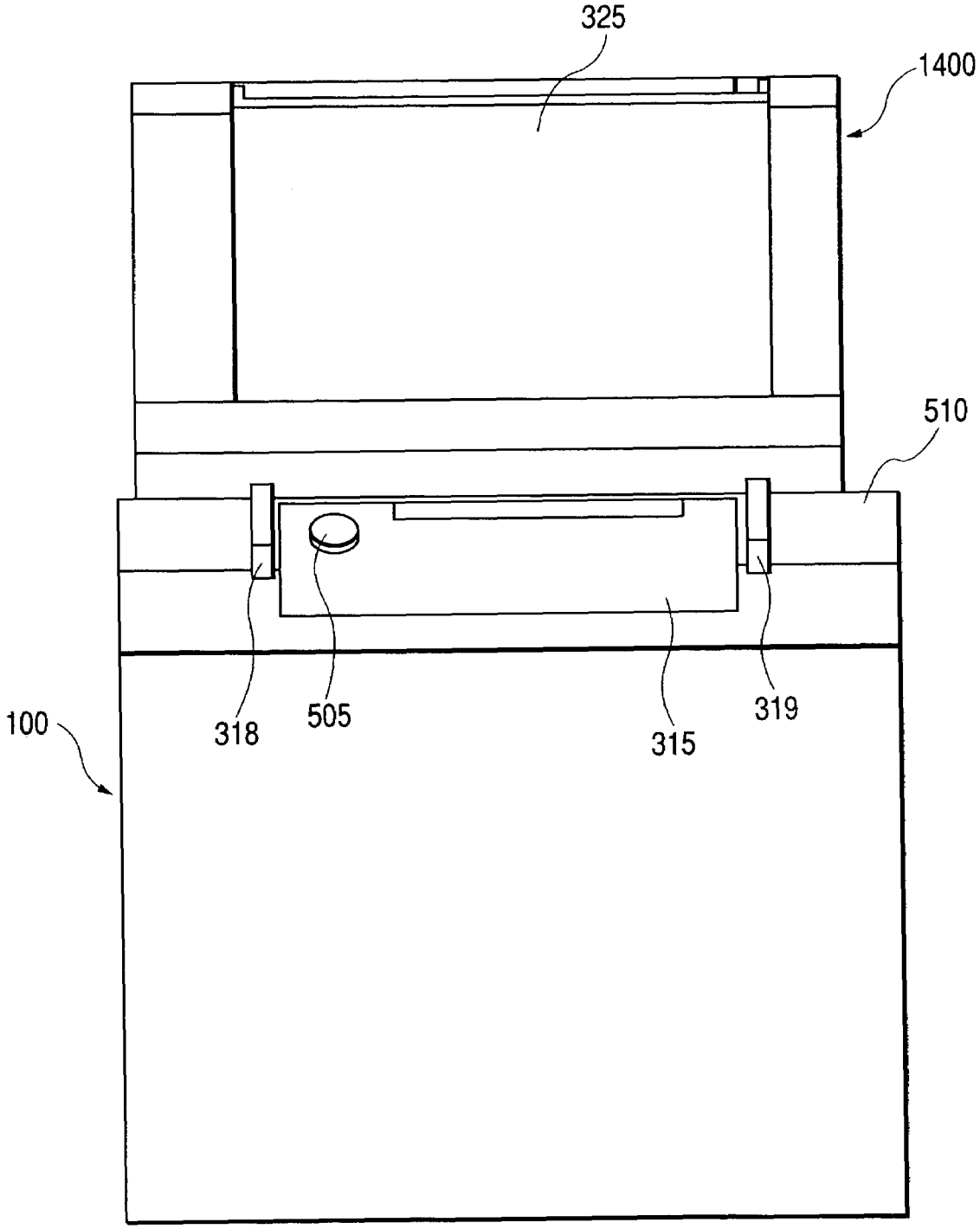
FIG. 32 is a front view of an image forming apparatus.
Figure 33:
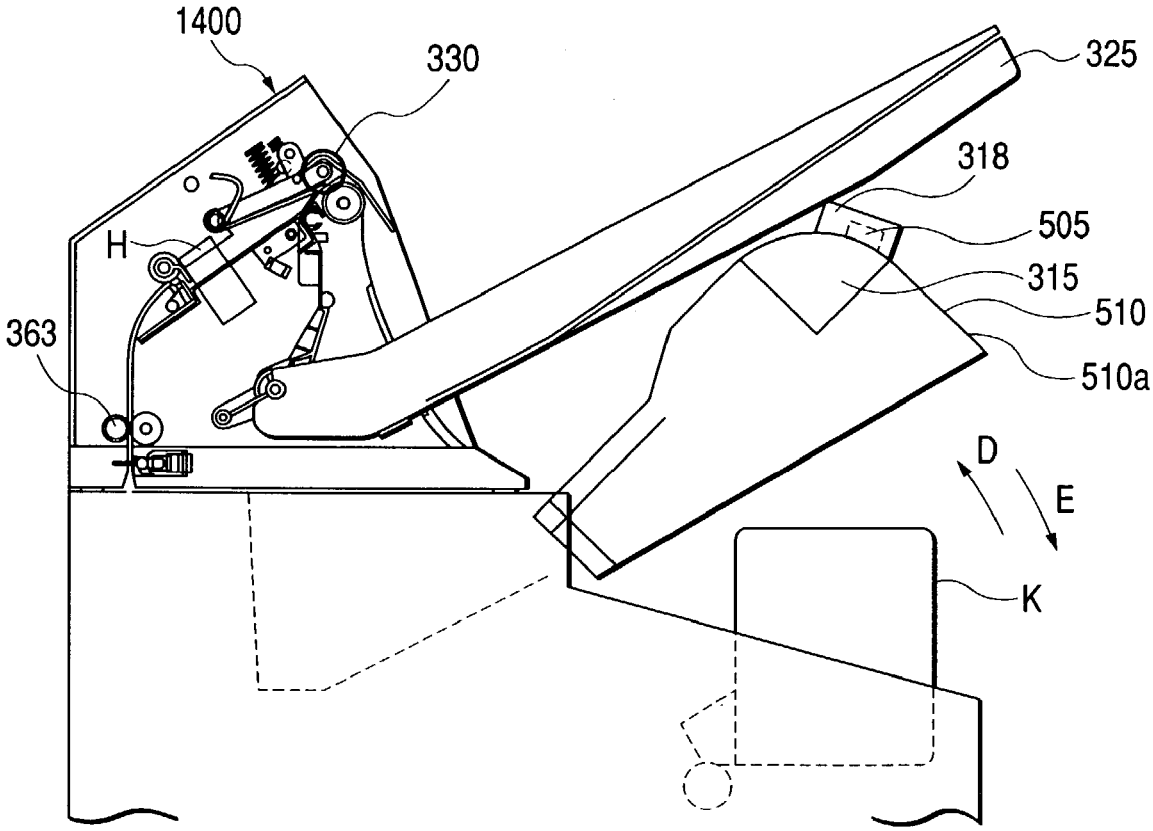
FIG. 33 is a cross-sectional view of the upper portions of the sheet post-treating apparatus which is the discharged sheet stacking apparatus in a state in which an openable and closable portion abuts against a discharged sheet stacking tray and an image forming apparatus main body.

A sixth embodiment of the image forming apparatus main body and the image forming apparatus according to the present invention will now be described with reference to the drawings. FIG. 31 is a cross-sectional view of the upper portions of a sheet post-treating apparatus and the image forming apparatus main body according to the present embodiment, FIG. 32 is a front view of the image forming apparatus, and FIG. 33 is a cross-sectional view of the upper portions of the sheet post-treating apparatus and the image forming apparatus main body in a state in which an openable and closable portion abuts against a sheet stacking tray. In this embodiment, portions overlapping those in the description of the fourth embodiment are given the same reference characters and need not be described.

As shown in FIG. 31, the image forming apparatus B according to the present embodiment is such that in lieu of the right rib 308 and left rib 309 of the sheet post-treating apparatus in the fourth embodiment, a right rib 318 and a left rib 319 are detachably provided in the image forming apparatus main body 100.

The image forming apparatus B is comprised of the image forming apparatus main body 100 and a sheet post-treating apparatus 1400.

The image forming apparatus main body 100 has a cartridge cover 510 provided in the upper portion of the image forming apparatus main body 100. As shown in FIG. 32, the cartridge cover 510 has an operating portion 315, and the right rib 318 and the left rib 319 are detachably provided at locations avoiding the operating portion 315 (the outside of the operating portion 315 in the widthwise direction of the sheet). The operating portion 315 has an operating button 505 protruding from the outer peripheral surface 510*a* of the cartridge cover 510, and the right rib 318 and the left rib 319 are taller than the height of the operating button 505.

The sheet post-treating apparatus 1400 receives sheets discharged out of the printer (image forming apparatus) main body, and stacks them on a discharged sheet stacking tray 325 by entrance rollers 363 and discharge rollers 330.

Reference is now had to FIG. 33 to describe the relation among the discharged sheet stacking tray 325, the cartridge cover 510 and the operating button 505 when the cartridge cover 510 is opened.

When the user opens the cartridge cover 510 by a predetermined angle, the right rib 318 and the left rib 319 provided on the cartridge cover 510 contact with the discharged sheet stacking tray 325, as shown in FIG. 33. The cartridge cover 510 is adapted not to contact with the other portions of the discharged sheet stacking tray 325 than the right rib 318 and the left rib 319. Consequently, it never happens that the operating button 505 protruding from the outer peripheral surface 510*a* of the cartridge cover 510 contacts with the discharged sheet stacking tray 325.

By such a construction, as in the above-described fourth embodiment, it never happens that the operating button 505 is depressed by mistake during the opening and closing of the cartridge cover 510, and the malfunctioning during the opening and closing of the cartridge cover 510 can be prevented. Also, it never happens that the liquid crystal panel or the like of the operating portion 315 collides against the discharged sheet stacking tray 325, and the protection of such a part easy to damage as the liquid crystal panel can also be effected.

Also, in the sheet post-treating apparatus 1400, unlike the sheet post-treating apparatus 1300 according to the fourth embodiment, the image forming apparatus main body 100 has the function of preventing the malfunctioning of the operating button 505. Therefore, the image forming apparatus main body 100, even when any sheet post-treating apparatus is connected to above it, can effect the prevention of the malfunctioning of the image forming apparatus B and the prevention of the damaging of the liquid crystal panel or the like by the operating portion 315 colliding against the discharged sheet stacking tray 325 during the opening and closing of the cartridge cover 510.

What is claimed is:

1. A discharged sheet stacking apparatus comprising:

a sheet treating portion which effects treatment on conveyed sheets;

a discharged sheet stacking tray provided in the lower portion of said sheet treating portion on which the sheets discharged from said sheet treating portion are stacked, a position of said discharged sheet stacking tray being variable;

a holding portion which holds said discharged sheet stacking tray in a first position or a second position above the first position, and a position detecting portion which detects that said discharged sheet stacking tray is at the second position, wherein the sheets are discharged from said sheet treating portion to said discharged sheet stacking tray at the first position, and wherein said position detecting portion also detects a jam of the sheets stacked on said discharged sheet stacking tray.

2. A discharged sheet stacking apparatus according to claim 1, wherein said holding portion includes an engagement portion provided on said discharged sheet stacking tray and a rotary member having an engaged portion to engage with the engagement portion, wherein said holding portion holds said discharged sheet stacking tray at a second position by effecting engagement between the engagement portion and the engaged portion, releases the engagement between the engagement portion and the engaged portion by rotation of the rotary member, and releases said discharged sheet stacking tray at the second position.

3. An image forming apparatus comprising:

a discharged sheet stacking apparatus according to claims 1 and 2; and an image forming apparatus main body to which said discharged sheet stacking apparatus is detachably connected upwardly and forms images on sheets.

4. An image forming apparatus comprising:

an image forming apparatus main body having an openable and closable portion that is openable and closable;

an image forming portion provided in said image forming apparatus main body and which forms images on sheets; and a discharged sheet stacking apparatus, said discharged sheet stacking apparatus comprising:

a sheet treating portion which effects treatment on the sheets on which images have been formed by said image forming portion;

a discharged sheet stacking tray provided in the lower portion of said sheet treating portion and on which the sheets discharged from said sheet treating portion are stacked, a position of said discharged sheet stacking tray being variable; and a holding portion which holds said discharged sheet stacking tray at a first position or a second position above the first position, wherein said discharged sheet stacking tray is located above the openable and closable portion.

5. An image forming apparatus according to claim 4, wherein said discharged sheet stacking tray has a receiving portion which receives said openable and closable portion at a location opposed to said openable and closable portion.

6. An image forming apparatus according to claim 5, wherein said receiving portion is detachably provided on said discharged sheet stacking tray.

7. An image forming apparatus according to claim 5 or 6, wherein said receiving portion has, in a portion thereof against which said openable and closable portion abuts, a low friction member lower in coefficient of friction than said receiving portion.

8. An image forming apparatus according to any one of claims 4 to 6, wherein said discharged sheet stacking apparatus is detachably connected above said image forming apparatus main body.

9. An image forming apparatus comprising:

an image forming apparatus main body having an openable and closable portion which is openable and closable;

an image forming portion provided in said image forming apparatus main body and which forms images on sheets; and a discharged sheet stacking apparatus, wherein said discharged sheet stacking apparatus includes:

a sheet treating portion which effects treatment on the sheets on which images have been formed by said image forming portion;

a discharged sheet stacking tray provided in the lower portion of said sheet treating portion and which stacks the sheets discharged from said sheet treating portion, a position of said discharged sheet stacking tray being variable;

a holding portion which holds said discharged sheet stacking tray at a first position or a second position above the first position; and a contact preventing portion disposed at a location where said discharged sheet stacking tray abuts on said openable and closable portion in a state in which said openable and closable portion is opened, and wherein said contact preventing portion prevents said discharged sheet stacking tray from contacting with an operating portion provided on said openable and closable portion.

10. An image forming apparatus according to claim 9, wherein said contact preventing portion is a convex portion of a predetermined height provided on said discharged sheet stacking tray, and is disposed at a location avoiding said operating portion.

11. An image forming apparatus according to claim 10, wherein the convex portion provided on said discharged sheet stacking tray is detachably attachable to said discharged sheet stacking tray.

12. An image forming apparatus according to claim 9, wherein said discharged sheet stacking tray, when said discharged sheet stacking tray abuts against said openable and closable portion in the first position, is retractable to the second position.

13. An image forming apparatus according to claim 9, wherein said contact preventing portion is disposed in an area outside a projected portion of said operating portion onto said discharged sheet stacking tray.

14. An image forming apparatus according to claim 9, wherein said contact preventing portion, when said contact preventing portion abuts on said openable and closable portion, forms a space between said discharged sheet stacking tray and an operating button of said operating portion.

15. An image forming apparatus according to claim 9, wherein said contact preventing portion is a tray concave portion of a predetermined depth provided in an underside of said discharged sheet stacking tray, and is provided at a location where said operating portion and an operating button of said operating portion come into said tray concave portion when said openable and closable portion is opened and closed.

16. An image forming apparatus according to any one of claims 9 to 15, wherein said discharged sheet stacking apparatus is detachably connected above said image forming apparatus main body.

17. An image forming apparatus main body which forms images on sheets and to which a discharged sheet stacking apparatus is detachably connected, comprising an openable and closable portion, said discharged sheet stacking apparatus including:

a sheet treating portion which effects treatment on the sheets on which images have been formed by an image forming portion;

a discharged sheet stacking tray provided in the lower portion of said sheet treating portion and on which the sheets discharged from said sheet treating portion are stacked, a position of said discharged sheet stacking tray being variable; and a holding portion which holds said discharged sheet stacking tray at a first position or a second position that is above the first position, wherein said openable and closable portion is provided at a location where said discharged sheet stacking tray abuts on said openable and closable portion in a state in which said openable and closable portion is opened, and has a contact preventing portion which prevents the contact of said discharged sheet stacking tray with an operating portion provided on said openable and closable portion, and said contact preventing portion is a convex portion of a predetermined height detachably provided on said openable and closable portion, and is disposed at a location without contacting said operating portion.

18. An image forming apparatus having an image forming apparatus main body according to claim 17, and a discharged sheet stacking apparatus detachably connected above said image forming apparatus main body, and which stacks thereon the sheets on which the images have been formed by the image forming apparatus main body and which are discharged.

19. A discharged sheet stacking apparatus comprising:

a sheet treating portion which effects treatment on conveyed sheets;

a discharged sheet stacking tray provided in the lower portion of said sheet treating portion on which the sheets discharged from said sheet treating portion are stacked, a position of said discharged sheet stacking tray being variable;

a holding portion which holds said discharged sheet stacking tray in a first position or a second position above the first position; and a position detecting portion which detects that said discharged sheet stacking tray is at the second position;

wherein the sheets are discharged from said sheet treating portion to said discharged sheet stacking tray at the first position, and wherein said position detecting portion also detects that said discharged sheet stacking tray is fully loaded with said sheets.

20. A discharged sheet stacking apparatus according to claim 19, wherein said holding portion includes an engagement portion provided on said discharged sheet stacking tray and a rotary member having an engaged portion to engage with the engagement portion, wherein said holding portion holds said discharged sheet stacking tray at a second position by effecting engagement between the engagement portion and the engaged portion, releases the engagement between the engagement portion and the engaged portion by rotation of the rotary member, and releases said discharged sheet stacking tray at the second position.

21. An image forming apparatus comprising:

a discharged sheet stacking apparatus according to claim 19; and an image forming apparatus main body which said discharged sheet stacking apparatus is detachably connected upward to and forms images on sheets.

22. An image forming apparatus comprising:

a discharged sheet stacking apparatus according to claim 20; and an image forming apparatus main body which said discharged sheet stacking apparatus is detachably connected upward to and forms images on sheets.

* * * * *

UNITED STATES PATENT AND TRADEMARK OFFICE

CERTIFICATE OF CORRECTION

PATENT NO. : 6,973,285 B2
DATED : December 6, 2005
INVENTOR(S) : Junichi Sekiyama et al.

It is certified that error appears in the above-identified patent and that said Letters Patent is hereby corrected as shown below:

Title page,
Item [56], References Cited, FOREIGN PATENT DOCUMENTS,
"11060044 3/1999" should read -- 11-60044 3/1999 --.

Column 3,
Line 58, "locating" should read -- location --.

Column 7,
Line 24, "according, to" should read -- according to --.

Column 14,
Line 9, "frequenting-force" should read -- frequenting force --.

Signed and Sealed this

Sixteenth Day of May, 2006

JON W. DUDAS
*Director of the United States Patent and Trademark Office*